US008408933B2

(12) United States Patent
Myong

(10) Patent No.: US 8,408,933 B2
(45) Date of Patent: Apr. 2, 2013

(54) ATTACHMENT RING FOR ATTACHING A SHIELD OF AN ELECTRICAL CABLE TO A BACKSHELL

(75) Inventor: Inho Myong, Newark, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/531,384

(22) Filed: Jun. 22, 2012

(65) Prior Publication Data

US 2012/0282810 A1 Nov. 8, 2012

Related U.S. Application Data

(63) Continuation-in-part of application No. 12/939,279, filed on Nov. 4, 2010, now Pat. No. 8,241,054.

(51) Int. Cl.
*H01H 13/627* (2006.01)

(52) U.S. Cl. ..... 439/358

(58) Field of Classification Search ..... 439/92, 439/100, 83, 367, 799, 777, 98, 833, 161
See application file for complete search history.

(56) References Cited

U.S. PATENT DOCUMENTS

| | | | | |
|---|---|---|---|---|
| 2,173,190 | A * | 9/1939 | Wilkening | 277/460 |
| RE23,402 | E * | 8/1951 | Mulholland | 57/119 |
| 3,990,765 | A | 11/1976 | Hill | |
| 4,629,275 | A | 12/1986 | Maul | |
| 5,052,944 | A | 10/1991 | Mitani et al. | |
| 5,406,032 | A | 4/1995 | Clayton et al. | |
| 6,663,415 | B1 | 12/2003 | Wu | |
| 7,182,611 | B2 | 2/2007 | Borden et al. | |
| 7,207,816 | B1 | 4/2007 | Friske | |
| 7,544,085 | B2 | 6/2009 | Baldwin et al. | |
| 2008/0295567 | A1 * | 12/2008 | Thielges et al. | 72/481.7 |

FOREIGN PATENT DOCUMENTS

| | | | |
|---|---|---|---|
| EP | 0053745 | A1 | 6/1982 |
| EP | 0236183 | A1 | 9/1987 |

OTHER PUBLICATIONS

International Search Report for International Application No. PCT/US2011/057525, mailed Dec. 2, 2011.

* cited by examiner

*Primary Examiner* — Tulsidas C Patel
*Assistant Examiner* — Phuongchi Nguyen

(57) ABSTRACT

An attachment ring is provided for attaching a shield of an electrical cable to a backshell. The attachment ring includes an annular body including a shape memory material that is heat recoverable. The body is configured to extend at least partially around the shield and a fitting of the backshell to hold the shield on the fitting in contact with the fitting. The body includes a single segment having a first end that includes a first connection member, and a second end that opposes the first end. The second end has a second connection member that is configured to be interlocked with the first connection member of the first end to connect the first and second ends together such that the single segment of the body defines a continuous ring.

17 Claims, 11 Drawing Sheets

Detail C

Detail D

ATTACHMENT RING FOR ATTACHING A SHIELD OF AN ELECTRICAL CABLE TO A BACKSHELL

CROSS-REFERENCE TO RELATED APPLICATION

The present application is a continuation-in-part of U.S. patent application Ser. No. 12/939,279, which was filed on Nov. 4, 2010, and is entitled "Attachment Ring for Attaching a Shield of an Electrical Cable to a Backshell", the entire disclosure of which is incorporated herein by reference.

BACKGROUND OF THE INVENTION

The subject matter described and/or illustrated herein relates generally to electrical cables, and more particularly, to attachment rings for attaching a shield of an electrical cable to a backshell.

Many electrical cables include an electrically conductive shield that extends around one or more insulated electrical conductors of the cable. The shield blocks electrical interference between the electrical conductors of the cable and the electrical conductors of neighboring cables and/or other neighboring electrical devices. An end of an electrical cable is sometimes terminated to an electrical connector to facilitate electrical connection of the electrical cable to another electrical cable or another electrical device. When terminated to an electrical connector, the shield of an electrical cable may be attached to a backshell that is connected to the electrical connector. The backshell may be used, for example, to protect, electrically shield, and/or provide strain relief to the connection points between the electrical conductors of the electrical cable and the corresponding electrical contacts of the electrical connector.

One method of attaching the shield of an electrical cable to a backshell includes receiving an end of the shield over a fitting of the backshell. An attachment ring fabricated from a shape memory material that is heat recoverable is sometimes used to hold the end of the shield on the fitting. Specifically, the attachment ring is positioned to extend around the circumference of the shield end. Heat is then applied externally by a heat source or generated by the application of current to the attachment ring. The heat applied to the attachment ring recovers, e.g., shrinks, the attachment ring into engagement with the end of the shield. The engagement between the end of the shield and the attachment ring holds the end of the shield on the fitting between the attachment ring and the fitting.

At least some known attachment rings are one-piece continuous rings. Accordingly, the attachment ring is typically positioned over the end of the shield before the end of the shield is received over the fitting of the backshell. In other words, the end of the shield and the insulated electrical conductors of the electrical cable are fed through the attachment ring before the end of the shield is received over the fitting. But, positioning the attachment ring over the end of the shield before the shield is received over the fitting may be time consuming and/or difficult, which may increase a cost of terminating the electrical cable to the electrical connector and/or may decrease the number of electrical cables that can be terminated to electrical connectors within a given time period. For example, it may be difficult to hold the attachment ring in position over the end of the shield as the end of the shield is received over the fitting. Rather, the attachment ring may move along the length of the electrical cable in a direction away from the end that is being terminated to the electrical connector and toward the other end of the electrical cable. Once the end of the shield is received over the fitting of the backshell, it may be time consuming and/or frustrating for a person to locate the attachment ring along the length of the cable and position the attachment ring back over the end of the shield.

Moreover, the only way to position a one-piece continuous attachment ring over the end of the shield after the end of the shield is received over the fitting is to position the attachment ring over the other end of the cable. The attachment ring must then be moved along the entire length of the electrical cable to the end that is being terminated to the electrical connector, which may also be time consuming and/or difficult. Positioning the attachment ring over the other end of the cable and moving the attachment ring along the entire length of the cable may also require that the other end of the cable is not terminated and/or mechanically connected to an electrical connector or other electrical device.

Another disadvantage of at least some known attachment rings is removal of the attachment rings from the shield. An attachment ring may be removed from a shield during disassembly of the end of the electrical cable from the electrical connector to enable the shield to be removed from the fitting of the backshell. Another reason for removing an attachment ring is if the actual diameter of the circumference of the shield is greater than the estimated diameter for which the size of the attachment ring was selected, for example because additional components were added between the fitting and the shield and/or because of a greater than expected dimensional variance of the shield. Known methods for removing a one-piece continuous attachment ring from a shield include cutting the attachment ring. However, due to the relatively strong shape memory materials that are used to fabricate at least some known attachment rings, cutting the attachment ring may be difficult, time consuming, and/or require special tooling (e.g., an electrical power tool and/or the like). Moreover, cutting the attachment ring may damage the fitting of the backshell, the electrical cable, and/or the shield in the proximity of the cutting operation, which may result in a costly repair.

BRIEF DESCRIPTION OF THE INVENTION

In one embodiment, an attachment ring is provided for attaching a shield of an electrical cable to a backshell. The attachment ring includes an annular body including a shape memory material that is heat recoverable. The body is configured to extend at least partially around the shield and a fitting of the backshell to hold the shield on the fitting in contact with the fitting. The body includes a single segment having a first end that includes a first connection member, and a second end that opposes the first end. The second end has a second connection member that is configured to be interlocked with the first connection member of the first end to connect the first and second ends together such that the single segment of the body defines a continuous ring.

In another embodiment, an electrical cable assembly includes an electrical cable having a shield. The electrical cable assembly also includes a backshell having a fitting. The shield of the electrical cable is received over the fitting. The electrical cable assembly further includes an attachment ring for attaching the shield to the fitting. The attachment ring includes an annular body including a shape memory material that is heat recoverable. The body is configured to extend at least partially around the shield and the fitting of the backshell to hold the shield on the fitting in contact with the fitting. The body comprises a single segment that includes a first end having a first connection member, and a second end that opposes the first end. The second end has a second connection member that is configured to be interlocked with the first connection member of the first end to connect the first and second ends together such that the body defines a continuous ring. The connection between the first and second ends is configured to be broken by twisting the body at a joint of the first and second connection members.

In another embodiment, an attachment ring is provided for attaching a shield of an electrical cable to a backshell. The attachment ring includes an annular body including a shape memory material that is heat recoverable. The body is configured to extend at least partially around the shield and a fitting of the backshell to hold the shield on the fitting in contact with the fitting. The body includes a single segment that includes a first end having a first connection member that includes a groove that extends into the body at an oblique angle relative to the body. The segment includes a second end that opposes the first end. The second end has a second connection member. The second connection member includes a latch projection that extends outward at an oblique angle relative to a portion of the body from which the latch projection extends. The latch projection is received within the groove such that the first and second connection members are interlocked.

DETAILED DESCRIPTION OF THE INVENTION

Figure 1:
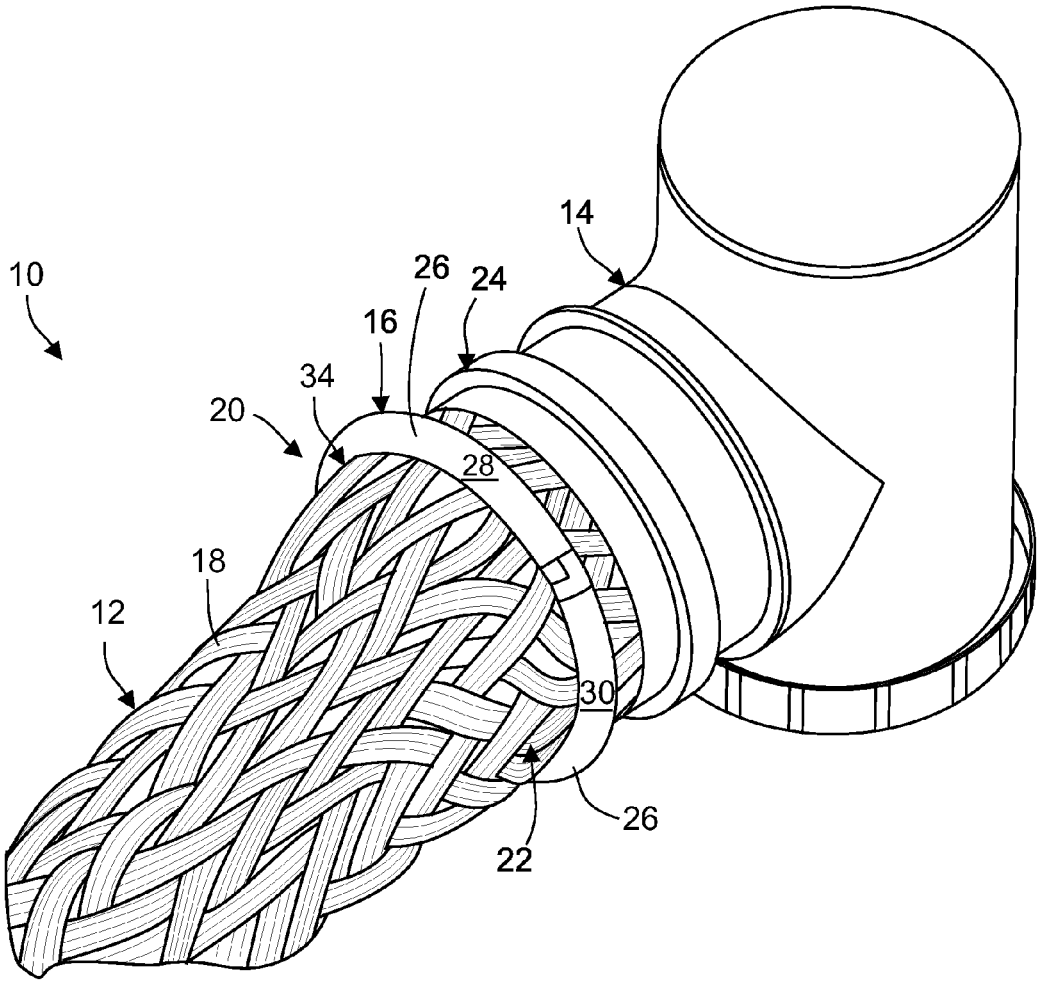
FIG. 1 is a perspective view of a portion of an exemplary embodiment of an electrical cable assembly.

FIG. 1 is a perspective view of a portion of an exemplary embodiment of an electrical cable assembly 10. The electrical cable assembly 10 includes an electrical cable 12, a backshell 14, and an attachment ring 16. The electrical cable 12 includes a shield 18. The backshell 14 is configured to be connected to an electrical connector (not shown) that terminates an end 20 of the electrical cable 12. The termination of the electrical cable end 20 to the electrical connector includes attaching an end 22 of the shield 18 to the backshell 14 using the attachment ring 16. More specifically, the end 22 of the shield 18 is received over a fitting 24 of the backshell 14. The attachment ring 16 extends at least partially around the end 22 of the shield 18 and the fitting 24 to hold the shield end 22 on the fitting 24 in contact with the fitting 24. As will be described in more detail below, the attachment ring 16 comprises a body 26 that includes at least two discrete segments 28 and 30 that are connected together to define a length L (FIG. 3) of the body 26 that extends at least partially around a circumference 34 of the shield 18 (at the end 22) and a circumference 36 (FIG. 2) of the fitting 24.

Figure 2:
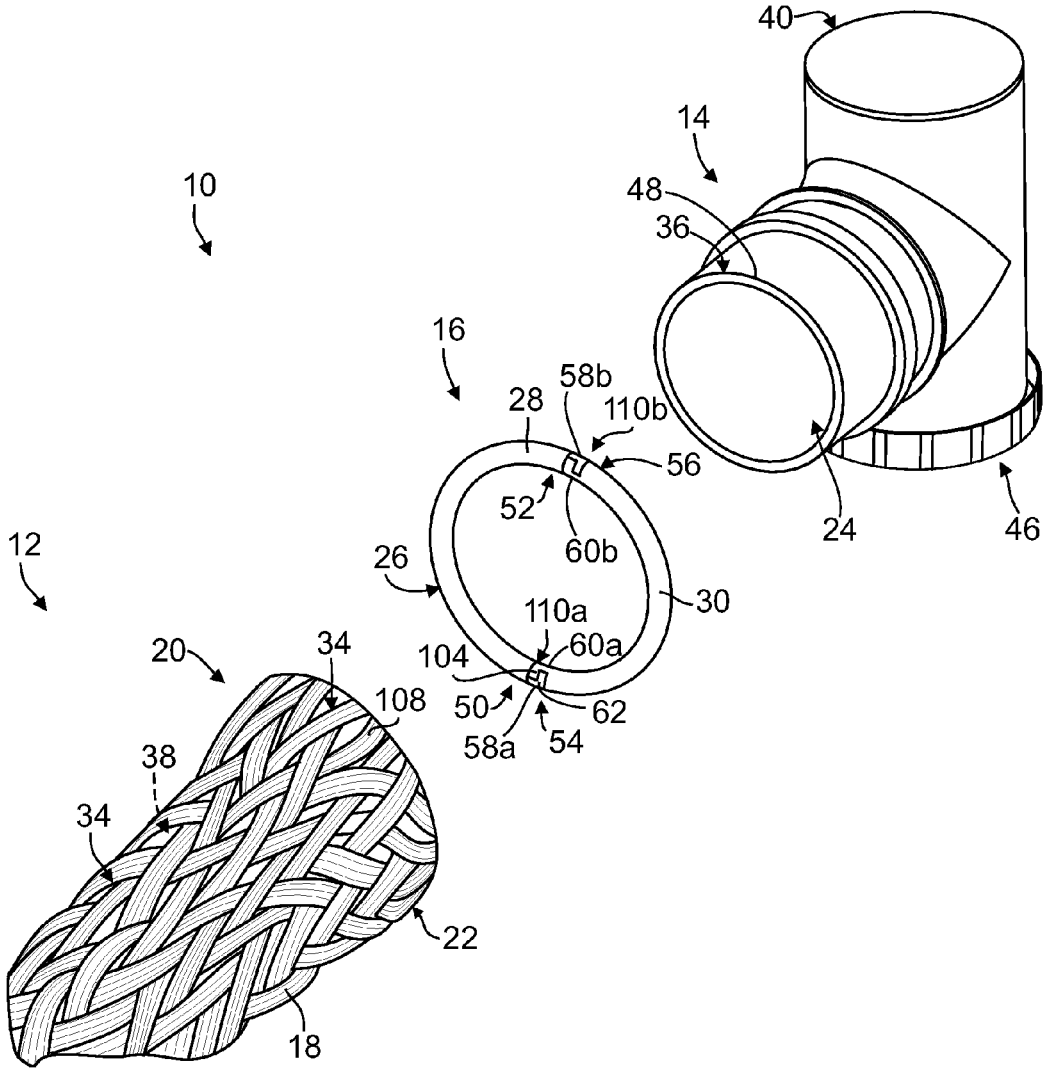
FIG. 2 is a partially exploded perspective view of the electrical cable assembly shown in FIG. 1.

FIG. 2 is a partially exploded perspective view of the electrical cable assembly 10. The electrical cable 12 extends a length from the end 20 to an opposite end (not shown). The electrical cable 12 includes one or more insulated conductor assemblies (not shown). Each insulated conductor assembly includes one or more electrical conductors (not shown) encapsulated by an electrically insulative layer (not shown). Some or all of the electrical conductors may be configured to carry electrical data signals. Optionally, the electrical conductors include one or more differential pairs of signal conductors. Some or all of the differential pairs are optionally arranged as twisted wire pairs. In some embodiments, one or more of the electrical conductors may be configured to carry electrical power and/or electrical ground. The electrical cable 12 may include any number of the insulated conductor assemblies, each of which may include any number of electrical conductors.

The shield 18 extends around the insulated conductor assemblies along at least a portion of the length of the electrical cable 12. The shield 18 includes a central passageway 38 that extends along the length of the shield 18 and receives the insulated conductor assemblies therein. The shield 18 facilitates shielding the insulated conductor assemblies of the electrical cable 12 from the electrical conductors (not shown) of neighboring cables (not shown) and/or other neighboring electrical devices (not shown). The shield 18 may be electrically connected to an electrical ground or other electrical source at one or both ends of the electrical cable 12. For example, the fitting 24 of the backshell 14 may provide an electrical connection between the end 22 of the shield 18 and an electrical ground or other electrical source. The shield 18 may be fabricated from any electrically conductive materials having any structure, such as, but not limited to, a conductive fabric, a conductive tape, a metallic (e.g., copper and/or the like) foil, aluminum/polyester (e.g., polyethylene terephthalate) tape, a conductive sleeve formed from one or more sheets of material, a braid of electrical conductor strands, and/or the like. In the exemplary embodiment, and as can be seen in FIGS. 1 and 2, the shield 18 is fabricated from a braid of electrical conductor strands.

Optionally, the electrical cable 10 includes an electrically insulative cable jacket (not shown) that extends around the circumference 34 of shield 18 along at least a portion of the length of the electrical cable 10. Although shown as including an approximately flat shape, the electrical cable 10 may additionally or alternatively include any other shape, such as, but not limited to, a cylindrical shape, a parallelepiped shape, and/or the like.

The backshell 14 includes a body 40, which includes the fitting 24. The backshell 14 includes a connection interface 46 at which the backshell 14 connects to the electrical connector (not shown). The electrical connector includes a plurality of electrical contacts (not shown) that include terminating segments (not shown) that terminate the electrical conductors of the electrical cable 12. More specifically, when the end 20 of the electrical cable 12 is terminated by the electrical connector, the terminating segments of the electrical contacts of the electrical connector are electrically connected to corresponding electrical conductors of the electrical cable 10 at corresponding connection points (not shown). The backshell 14 may surround the connection points to, for example, protect, electrically shield, and/or provide strain relief to the connection points.

The fitting 24 of the backshell 14 is configured to receive the end 22 of the shield 18 thereon in contact therewith. In the exemplary embodiment, the fitting 24 includes an approximately smooth outer surface 48 that receives the shield end 22 thereon. But, some or all of the outer surface 48 of the fitting 24 may alternatively include a texture (such as, but not limited to, knurls, one or more threads, one or more grooves, one or more ridges, and/or the like) to, for example, facilitate providing friction and/or stiction between the shield 18 and the outer surface 48 of the fitting 24. In addition or alternative to providing friction and/or stiction, a ridge on the outer surface 48 may facilitate providing the fitting 24 with a portion that has a larger diameter than the attachment ring 16 after the body 26 of the attachment ring 16 has been shrunk into engagement with the end 22 of the shield 18, as will be described below. Such a larger-diameter ridge may prevent the attachment ring 16 from moving along the length of the electrical cable 12 off of the fitting 24. The outer surface 48 defines the circumference 36 of the fitting 24. When the end 20 of the electrical cable 12 is terminated by the electrical connector, the end 22 of the shield 18 is received over the fitting 24 in engagement with the outer surface 48 of the fitting 24. When the shield end 22 is received over the fitting 24, at least a portion of the fitting 24 is received within the central passageway 38 of the shield 18. Optionally, the body 40 of the backshell 14 is electrically conductive such that the engagement between the shield end 22 and the fitting 24 electrically connects the backshell 14 to the shield 18. The backshell 14 is optionally electrically connected to an electrical ground or other electrical source, for example via the electrical connector or otherwise.

Figure 3:
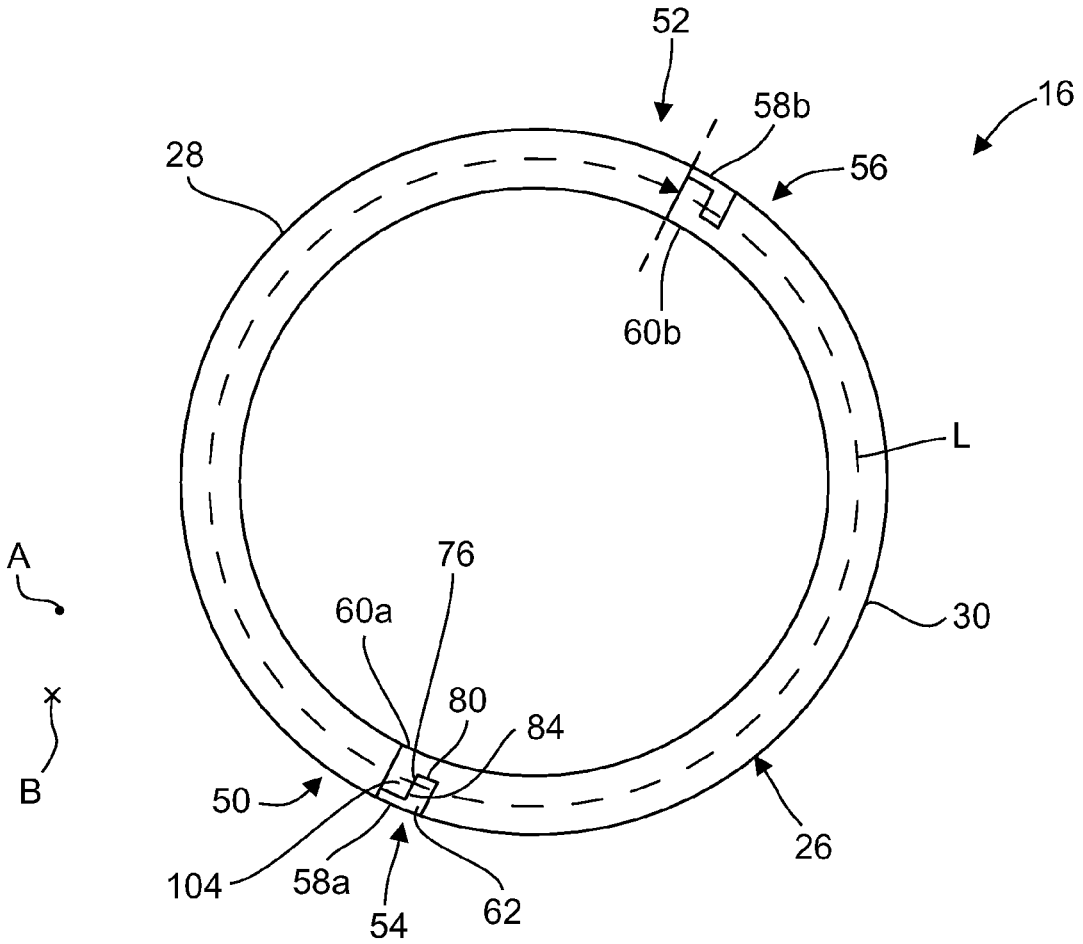
FIG. 3 is a perspective view of an exemplary embodiment of an attachment ring of the electrical cable assembly shown in FIGS. 1 and 2.

FIG. 3 is a perspective view of an exemplary embodiment of the attachment ring 16. The attachment ring 16 includes the body 26, which is configured to extend at least partially around the end 22 (FIGS. 1 and 2) of the shield 18 (FIGS. 1 and 2). More particularly, the body 26 extends the length L, which in the exemplary embodiment of the body 26 extends along a continuous annular path. In other words, the length L of the body 26 defines an annular shape of the body 26 that is continuous along the length L. The length L of the body 26 is configured to extend at least partially around the circumferences 34 and 36 (FIGS. 1 and 2) of the shield 18 (at the end 22) and the fitting 24 (FIGS. 1 and 2), respectively, to hold the shield end 22 on the fitting 24 in contact with the fitting 24. Specifically, the body 26 engages the shield end 22 to hold the shield end 22 between the fitting 24 and the body 26. In the exemplary embodiment of the body 26, the continuous length L of the body 26 extends around an entirety of the circumferences 34 and 36. But, the length L of the body 26 may alternatively be non-continuous such that the length L of the body 26 extends around only a portion of the circumferences 34 and 36. In such embodiments wherein the length L of the body 26 is not continuous, two segments (e.g., the segments 28 and 30) of the body 26 will have ends (e.g., the ends 52 and 56) that oppose each other, are spaced apart by a gap, and may not include any mechanical connectors.

At least a portion of the body 26 of the attachment ring 16 is fabricated from one or more shape memory materials that recover upon exposure to a heat source. In other words, at least a portion of the body 26 of the attachment ring 16 is heat recoverable such that at least a portion of the body 26 shrinks upon the application of heat thereto. As will be described below, the body 26 of the attachment ring 16 is positioned over the end 22 of the shield 18 and exposed to a heat source (not shown) to shrink the body 26 into engagement with the shield end 22. The body 26 may be fabricated from one or more shape memory materials, such as, but not limited to, a titanium/nickel-based alloy, a titanium/nickel/niobium alloy, a titanium/nickel/iron alloy, a copper based alloy, and/or the like.

Figure 4:
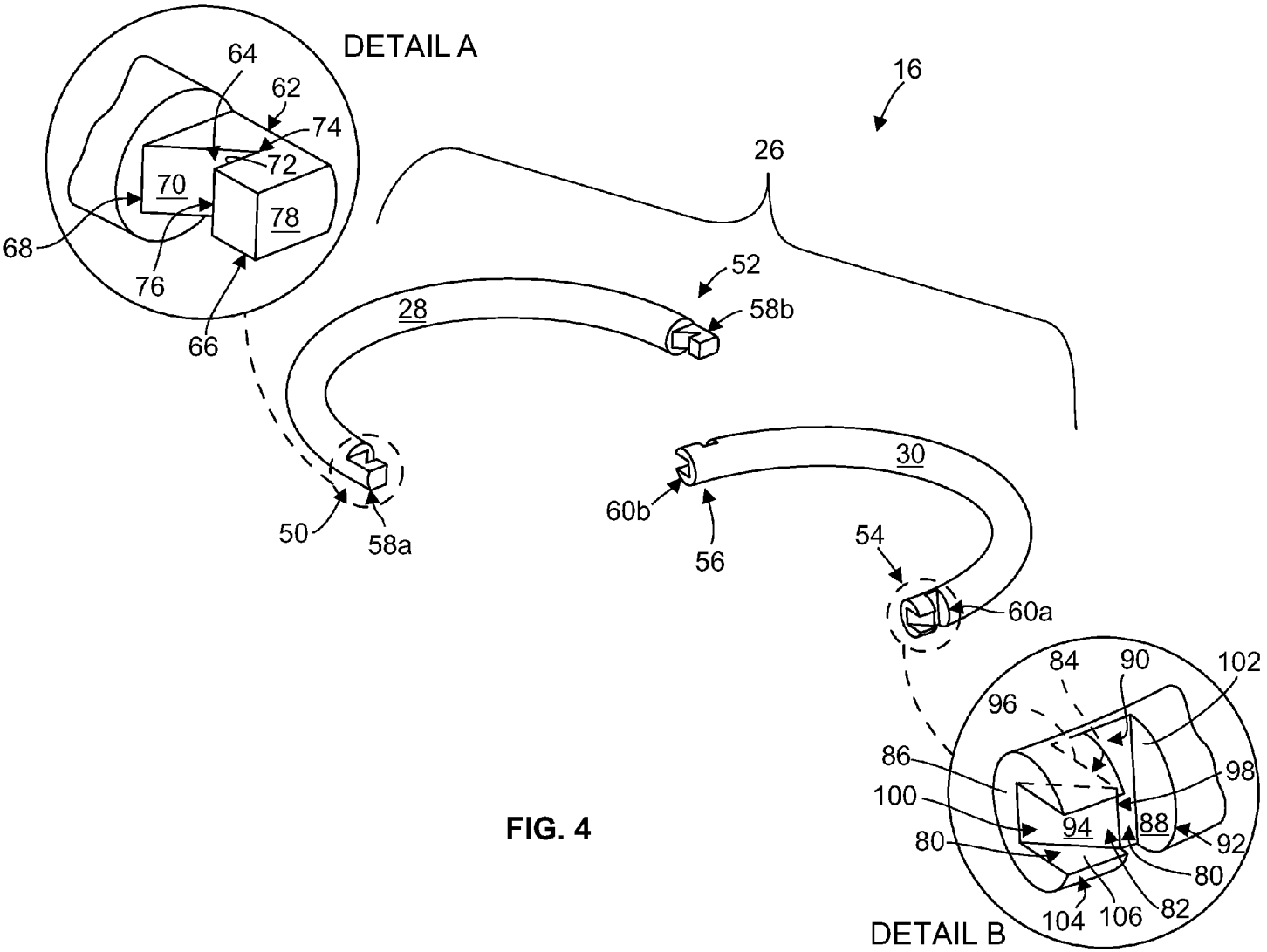
FIG. 4 is an exploded perspective view of the attachment ring shown in FIG. 3.

FIG. 4 is an exploded perspective view of the attachment ring 16. As briefly described above, the body 26 of the attachment ring 16 includes at least two segments 28 and 30. The segments 28 and 30 are discrete from each other and are connected together to define the length L (FIG. 3) of the body 26. The exemplary embodiment of the body 26 includes two segments 28 and 30 that connect together to define an entirety of the length L of the body 26. But, the body 26 may include any number of segments that define the entirety of the length L of the body 26. As used herein, the term "discrete" is intended to mean constituting a separate part or component. In some embodiments, the discrete segments 28 and 30 are separately formed from each other. In other embodiments, the segments 28 and 30 are formed integrally with each other and are thereafter severed from each other. Once severed, the segments 28 and 30 are separate components from each other that may be connected together. Each of the segments 28 and 30 may be referred to herein as a "first segment" and/or a "second segment".

The segment 28 extends a length from an end 50 to an opposite end 52. Similarly, the segment 30 extends a length from an end 54 to an opposite end 56. In the exemplary embodiment of the body 26, each of ends 50 and 52 of the segment 28 includes a mechanical connector 58*a* and 58*b*, respectively, and each of the ends 54 and 56 of the segment 30 includes a mechanical connector 60*a* and 60*b*, respectively. The mechanical connector 58*a* of the end 50 of the segment 28 interlocks with the mechanical connector 60*a* of the end 54 of the segment 30 to connect the segments 28 and 30 together at the ends 50 and 54. Similarly, the mechanical connector 58*b* of the end 52 of the segment 28 interlocks with the mechanical connector 60*b* of the end 56 of the segment 30 to connect the segments 28 and 30 together at the ends 52 and 56. In the exemplary embodiment of the body 26, when the ends 50 and 54 are connected together and the ends 52 and 56 are connected together, the segments 28 and 30 define the entirety of the continuous length L of the body 26. In the exemplary embodiment of the body 26, each of the segments 28 and 30 includes a circular cross-sectional shape. But, each segment 28 and 30 may additionally or alternatively include any other cross-sectional shape, such as, but not limited to, a quadrilateral shape, an oval shape, and/or the like. The mechanical connectors 58*a*, 58*b*, 60*a*, and 60*b* may each be referred to herein as a "connection member" and/or a "connection feature".

Optionally, the mechanical connectors 58*a*, 58*b*, 60*a*, and/or 60*b* are fabricated from the shape memory material(s) that recovers upon exposure to a heat source. In the exemplary embodiment of the body 26, the mechanical connectors 58*a* and 58*b* are substantially identical to each other, and the mechanical connectors 60*a* and 60*b* are substantially identical to each other. Accordingly, only the structure of the mechanical connectors 58*a* and 60*a* will be described herein in detail. Referring now to Detail A of FIG. 4, the mechanical connector 58*a* includes a latch projection 62 having a notch 64 and an end 66. Optionally, the notch 64 extends into a radially inner side 68 of the latch projection 62. The notch 64 is defined by two walls 70 and 72 that intersect at an apex 74. The wall 72 defines a latch shoulder 76 of the latch projection 62. The end 66 of the latch projection 62 extends from the wall 72 to an end wall 78 of the latch projection 62. As will be described below, the latch projection 62 is configured to be received within a groove 80 of the mechanical connector 60*a* to connect the ends 50 and 54 of the segments 28 and 30, respectively, together. When the latch projection 62 is fully received within the groove 80, the notch 64 receives an embossment 82 of the mechanical connector 60*a* therein to interlock the connectors 58*a* and 60*a* together. More particularly, when the embossment 82 is received within the notch 64, the latch shoulder 76 of the latch projection 62 engages a latch shoulder 84 of the embossment 82 to interlock the connectors 58*a* and 60*a* together.

The walls 70 and 72 of the notch 64 may extend at any angle to each other. Although shown as being approximately planar, the wall 70 and/or the wall 72 may alternatively include a curved shape, a texture (such as, but not limited to, knurls, one or more threads, one or more grooves, one or more ridges, and/or the like), and/or the like. Moreover, rather than meeting at a pointed apex 74 as shown in the exemplary embodiment of the body 26, the walls 70 and 72 may meet at a curved apex (not shown). In the exemplary embodiment of the body 26, the notch 64 includes a triangular shape that is complementary with a shape of the embossment 82. But, the notch 64 may additionally or alternatively include any other shape besides triangular, whether or not the notch 64 includes a shape that is complementary with any shapes of the embossment 82.

The latch projection 62 may include any shape for being received within a groove 80 that includes any shape. In the exemplary embodiment of the body 26, excepting the notch 64, the latch projection 62 includes the shape of a parallelepiped. But, the latch projection 62 may additionally or alternatively include any other shape besides the shape of a parallelepiped. Optionally, the latch projection 62 includes a shape that is complementary with one or more shapes of the groove 80.

Referring now to Detail B of FIG. 4, the mechanical connector 60*a* includes the groove 80, which extends into the end 54 of the segment 30. Optionally, the groove 80 extends through an end wall 86 of the end 54 of the segment 30. The groove 80 extends a length into the end 54 to an end wall 88 of the groove 80. The groove 80 includes a bottom side 90. The embossment 82 extends outwardly at the bottom side 90 of the groove 80 toward a top side 92 of the groove 80. The embossment 82 is defined by two walls 94 and 96 that intersect at an apex 98. The wall 96 defines the latch shoulder 84 of the embossment 82, while the wall 94 defines a latch ramp 100 of the embossment 82. The latch ramp 100 slopes outwardly at the bottom side 90 to the apex 98. The groove 80 includes a recess 102 defined between the wall 96 and the end wall 88 of the groove 80. As will be described below, the recess 102 receives the latch projection end 66 of the mechanical connector 58*a* therein when the latch projection 62 is fully received within the groove 80.

Optionally, the mechanical connector 60*a* includes one or more anti-twist members 104 that, as will be described below, engage the latch projection 62 to hold the latch projection 62 within the groove 80 when the body 26 is twisted. In the exemplary embodiment of the body 26, the mechanical connector 60*a* includes two opposing anti-twist members 104. The anti-twist members 104 extend outwardly from the bottom side 90 of the groove 80 to the top side 92. The anti-twist members 104 include side walls 106 that oppose each other and define side walls of the groove 80. In the exemplary embodiment of the body 26, each anti-twist member 104 extends from the end wall 86 of the segment end 54 toward the end wall 88 along only a portion of the length of the groove 80. In other words, each anti-twist member 104 extends from the end wall 86 of the segment end 54 but does not extend all the way to the end wall 88 of the groove 80. Accordingly, the side walls 106 extend along only a portion of the length of the groove 80. Alternatively, one or both of the anti-twist members 104 extends along an entirety of the length of the groove 80 or is located at a different location along the length of the groove 80. For example, in some alternative embodiments, one or both of the anti-twist members 104 extends from and/or proximate the end wall 88 of the groove 80.

The groove 80 may include any shape for receiving a latch projection 62 that includes any shape. Optionally, the groove 80 includes a shape that is complementary with one or more shapes of the latch projection 62. The embossment 82 may include any shape for being received within a notch 64 that includes any shape. In the exemplary embodiment of the body 26, the embossment 82 includes a triangular shape that is complementary with the triangular shape of the notch 64. But, the embossment 82 may additionally or alternatively include any other shape besides triangular, whether or not the embossment 82 includes a shape that is complementary with any shapes of the notch 64. The walls 94 and 96 of the embossment 82 may extend at any angle to each other, and the wall 94 may have any amount of slope to define a latch ramp 100 having any amount of slope. The wall 94 and 96 are not limited to the approximately planar shape shown herein. Rather, the walls 94 and/or 96 may alternatively include a curved shape, a texture (such as, but not limited to, knurls, one or more threads, one or more grooves, one or more ridges, and/or the like), and/or the like. Moreover, rather than meeting at a pointed apex 98 as shown in the exemplary embodiment of the body 26, the walls 94 and 96 may meet at a curved apex (not shown). Although shown as including the shape of a parallelepiped, the recess 102 may include any shape for receiving a latch projection end 66 that includes any shapes.

To connect the end 50 of the segment 28 to the end 54 of the segment 30, the latch projection 62 of the mechanical connector 58*a* is inserted into the groove 80 of the mechanical connector 60*a*. The end 66 of the latch projection 62 engages the latch ramp 100 of the embossment 82 when the latch projection 62 is initially received into the groove 80. As the latch projection 62 is inserted further into the groove 80, the latch projection end 66 rides along the latch ramp 100 until the latch shoulder 76 of the latch projection 62 moves past the apex 98. Once the latch shoulder 76 has cleared the apex 98, the end 66 of the latch projection 62 moves toward the bottom side 90 of the groove 80 and into the recess 102. In other words, the latch projection end 66 snaps into the recess 102 such that the mechanical connectors 58*a* and 60*a* interlock together with a snap-fit arrangement. The segment 28 may bend along the length of the segment 28 to enable the end 66 of the latch projection 62 to ride along the latch ramp 100 and snap into the recess 102. Additionally or alternatively, the latch projection 62 may bend to enable the end 66 of the latch projection 62 to ride along the latch ramp 100 and snap into the recess 102.

Referring again to FIG. 3, the ends 50 and 54 of the segments 28 and 30, respectively, are shown connected together. When the mechanical connectors 58*a* and 60*a* are interlocked together as shown in FIG. 3, the latch shoulders 76 and 84 engage each other to hold the mechanical connectors 58*a* and 60*a* together. The anti-twist members 104 engage the latch projection 62 to hold the latch projection 62 within the groove 80. More particularly, the side walls 106 (FIG. 4) of the anti-twist members 104 engage the latch projection 62 to prevent the latch projection 62 from moving out of the groove 80 in the directions into and out of the page, indicated by the arrows A and B, respectively, in FIG. 3. For example, twisting the body 26 of the attachment ring 16 may exert a force on the latch projection 62 in the directions A and/or B. The side walls 106 (FIG. 4) of the anti-twist members 104 prevent the latch projection 62 from moving out of the groove 80 in the directions A and/or B to hold the mechanical connectors 58*a* and 60*a* together.

FIG. 3 also illustrates the ends 52 and 56 of the segments 28 and 30, respectively, connected together. The mechanical connectors 58*b* and 60*b* interlock together in a substantially similar manner to the mechanical connectors 58*a* and 60*a* and therefore connection of the ends 52 and 56 of the segments 28 and 30, respectively, will not be described in more detail herein.

Referring again to FIG. 2, to attach the end 22 of the shield 18 to the backshell 14, the shield end 22 is received over the fitting 24 of the backshell 14. The body 26 of the attachment ring 16 is then positioned over the end 22 of the shield 18. Specifically, the segments 28 and 30 are assembled over the end 22 of the shield 18. The ends 50 and 54 of the segments 28 and 30, respectively, are connected together by interlocking the mechanical connectors 58*a* and 60*a* as described above Likewise, the ends 52 and 56 of the segments 28 and 30, respectively, are connected together by interlocking the mechanical connectors 58*b* and 60*b*. Heat is then applied to the body 26 of the attachment ring 16 to recover, e.g., shrink, the body 26 into engagement with the end 22 of the shield 18. More particularly, exposing the body 26 to heat causes the diameter of the body 26 to reduce such that the body 26 engages a radially outer surface 108 of the shield 18. The length L of the body 26 extends at least partially around the circumferences 34 and 36 of the shield 18 (at the end 22) and the fitting 24. The body 26 thereby holds the shield end 22 between the fitting 24 and the body 26, as can be seen in FIG. 1. When the mechanical connectors 58*a*, 58*b*, 60*a*, and/or 60*b* are fabricated from the shape memory material(s), shrinkage of a portion or all of the mechanical connectors 58*a*, 58*b*, 60*a*, and/or 60*b* may facilitate increasing the strength of the interlocking connection between the mechanical connectors 58*a* and 60*a* and/or the mechanical connectors 58*b* and 60*b*.

Although the body 26 of the attachment ring 16 is described above as being assembled over the end 22 of the shield 18 after the shield end 22 is received over the fitting 24, the body 26 of the attachment ring 16 may be positioned over the shield end 22 before the shield end 22 is received over the fitting 24 (whether or not the segments 28 and 30 are connected together before the shield end 22 is received over the fitting 24). Heat may be applied to the body 26 of the attachment ring using any suitable method, structure, means, and/or the like, such as, but not limited to, thermally (e.g., using a heat gun, an oven, and/or the like), electrically (e.g., resistance heating and/or the like), and/or the like. Optionally, if heat is applied to the body 26 electrically, the body 26 may include an electrically insulating layer (not shown) that electrically isolates the body 26 from the shield 18 to force electrical current to flow through the body 26 during the electrical heating.

The discrete segments 28 and 30 that make up the body 26 of the attachment ring enable the attachment ring 16 to be assembled over the end 22 of the shield 18 after the shield end 22 has been received over the fitting 24 of the backshell 14, which is sometimes referred to as "side-entry" of the attachment ring 16. Accordingly, the end 22 of the shield 18 and the insulated electrical conductors of the electrical cable 12 do not need to be fed through the attachment ring 16 to position the attachment ring 16 over the shield end 22. Moreover, the side-entry of the body 26 of the attachment ring 16 enables the attachment ring 16 to be positioned over the shield end 22 after the shield 22 has been received over the fitting 24 without positioning the attachment ring 16 over the other end of the shield 22 and moving the attachment ring 16 along the entire length of the electrical cable 12 to the shield end 22.

When it is desired to remove the attachment ring 16 from the shield 18 (e.g., to disassemble the end 20 of the electrical cable 12 from the electrical connector, and/or the like), the body 26 can be broken at a joint 110*a* between the mechanical connectors 58*a* and 60*a* and/or at a joint 110*b* between the mechanical connectors 58*b* and 60*b*. For example, twisting of the body 26 at the joint 110*a* and/or 110*b* will break one or both of the corresponding anti-twist members 104 and/or the corresponding latch projection 62 to enable the segments 28 and 30 to come apart at the joint 110*a* and/or 110*b*. The body 26 may be twisted at the joint 110*a* and/or 110*b* using any hand tool, such as, but not limited to, pliers, vice-grips, and/or the like. The anti-twist members 104 and the latch projection 62 are fabricated with a strength such that the segments 28 and 30 will not come apart during twisting of the body 26 during normal use, operation, and/or life of the attachment ring 16. However, the anti-twist members 104 and/or the latch projection 62 are fabricated with a strength that enables the anti-twist members 104 and/or the latch projection 62 to break when twisted at the joint 110*a* and/or 110*b* using the hand tool.

As described above, in the exemplary embodiment of the body 26, the mechanical connector 58*a* of the end 50 of the segment 28 of the body 26 is substantially identical to the mechanical connector 58*b* of the end 52 of the segment 28. Similarly, the mechanical connector 60*a* of the end 54 of the segment 30 is substantially identical to the mechanical connector 60*b* of the end 56 of the segment 30. However, the mechanical connector 58*a* of the end 50 of the segment 28 may alternatively have a different structure than the mechanical connector 58*b* of the end 52 of the segment 28. Similarly, the mechanical connector 60*a* of the end 54 of the segment 30 may alternatively have a different structure than the mechanical connector 60*b* of the end 56 of the segment 30. For example, the end 52 of the segment 28 could include a mechanical connector 60*a* and the end 56 of the segment 30 could include a mechanical connector 58*a*. Moreover, the structures of the mechanical connectors 58*a* and 60*a* that connects the segment ends 50 and 54 together may be different than the structures of the mechanical connectors 58*b* and 60*b* that connect the segment ends 52 and 56 together. For example, while the mechanical connectors 58*a* and 60*a* may have the structures described above and illustrated in FIGS. 1-4, the mechanical connectors 58*b* and 60*b* may have other structures, such as, but not limited to, the structures of the mechanical connectors 258*a*, 260*a*, 258*b*, and/or 260*b* or the structures of the mechanical connectors 458*a*, 460*a*, 458*b*, and/or 460*b*.

Figure 5:
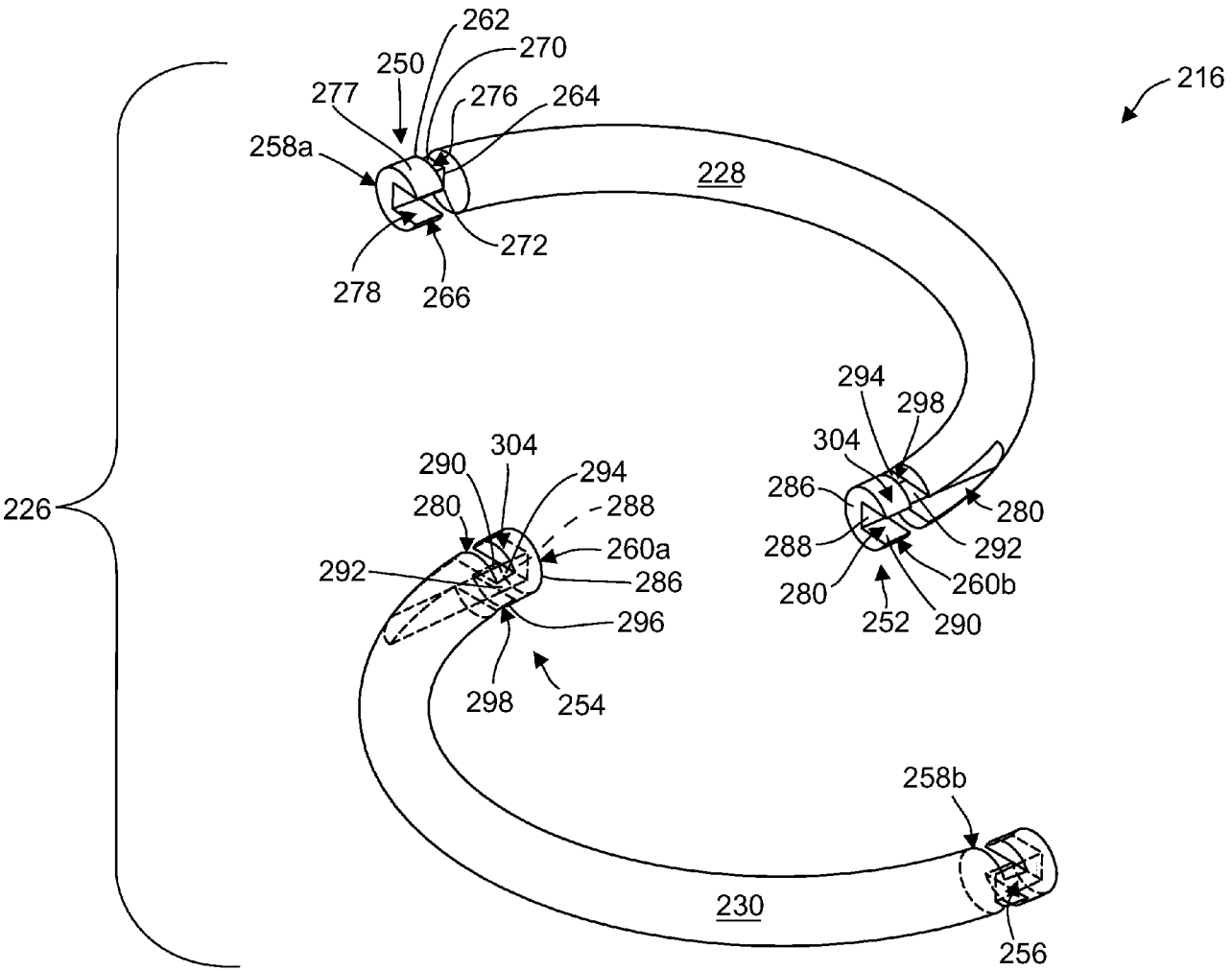
FIG. 5 is an exploded perspective view of an exemplary alternative embodiment of an attachment ring.

FIG. 5 is an exploded perspective view of an exemplary alternative embodiment of an attachment ring 216. The attachment ring 216 includes a body 226, which is configured to extend at least partially around the end 22 (FIGS. 1 and 2) of the shield 18 (FIGS. 1 and 2). The body 226 of the attachment ring 216 includes at least two segments 228 and 230. The segments 228 and 230 are discrete from each other and are connected together to define the length of the body 226. As will be described below, the segments 228 and 230 of the body 226 are hermaphroditic. Each of the segments 228 and 230 may be referred to herein as a "first segment" and/or a "second segment".

The segment 228 extends a length from an end 250 to an opposite end 252. Similarly, the segment 230 extends a length from an end 254 to an opposite end 256. Each of ends 250 and 252 of the segment 228 includes a respective mechanical connector 258*a* and 260*b* and each of the ends 254 and 256 of the segment 230 includes a mechanical connector 260*a* and 258*b*, respectively. The mechanical connector 258*a* of the end 250 of the segment 228 interlocks with the mechanical connector 260*a* of the end 254 of the segment 230 to connect the segments 228 and 230 together at the ends 250 and 254. Similarly, the mechanical connector 260*b* of the end 252 of the segment 228 interlocks with the mechanical connector 258*b* of the end 256 of the segment 230 to connect the segments 228 and 230 together at the ends 252 and 256. The mechanical connector 258*a* of the segment 228 is substantially identical to the mechanical connector 258*b* of the segment 230. Similarly, the mechanical connector 260*b* of the segment 228 is substantially identical to the mechanical connector 260*a* of the segment 230. Accordingly, the segments 228 and 230 are hermaphroditic. The mechanical connectors 258*a*, 258*b*, 260*a*, and 260*b* may each be referred to herein as a "connection member" and/or a "connection feature".

The mechanical connector 258*a* includes a latch projection 262 having a base 264 and an end 266. The base 264 includes two opposite walls 270 and 272 that define latch shoulders 276 of the latch projection 262. The end 266 of the latch projection 262 includes two opposing anti-twist members 277 that also define latch shoulders 278 of the latch projection 262. The mechanical connector 260*a* includes a groove 280, which extends into the end 254 of the segment 230. For clarity, some of the substantially identical elements/components of the mechanical connector 260*b* have been labeled in FIG. 5 to better illustrate the structure of the mechanical connector 260*a*. Optionally, the groove 280 extends through an end wall 286 of the end 254 of the segment 230. The groove 280 includes a groove segment 288 that extends between opposing anti-twist members 304 of the mechanical connector 260*a*. The anti-twist members 304 define opposing latch shoulders 290 of the groove 280. The groove 280 also includes a base 292 having two opposite walls 294 and 296 that define latch shoulders 298 of the groove 280.

To connect the end 250 of the segment 228 to the end 254 of the segment 230, the latch projection 262 of the mechanical connector 258*a* is inserted into the groove 280 of the mechanical connector 260*a*. The anti-twist members 277 of the end 266 of the latch projection 262 straddle the base 292 of the groove 280 such that the latch shoulders 278 of the latch projection 262 engage the corresponding latch shoulders 298 of the groove base 292. The base 264 of the latch projection 262 is received within groove segment 288 of the groove 280 such that the anti-twist members 304 of the groove 280 straddle the base 264 of the latch projection 262. The latch shoulders 276 of the base 264 of the latch projection 262 engage the corresponding latch shoulders 290 of the groove 280. When the mechanical connectors 258*a* and 260*a* are interlocked together as described above, the engagement between the latch shoulders 278 and 298 and the engagement between the latch shoulders 276 and 290 holds the mechanical connectors 258*a* and 260*a* together. The anti-twist members 277 and 304 prevent the latch projection 262 from moving out of the groove 280 when the body 226 is twisted.

Figure 6:
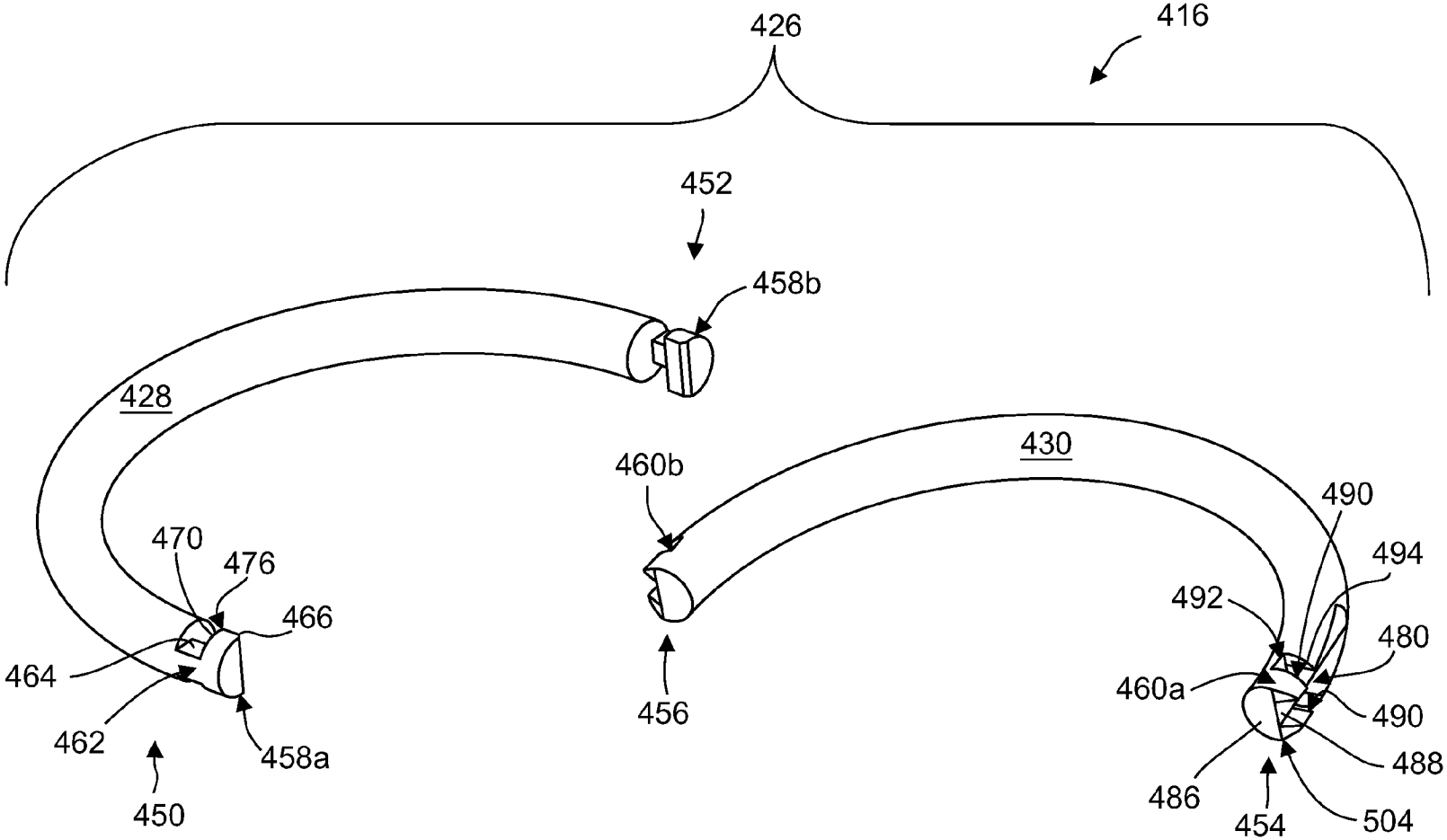
FIG. 6 is an exploded perspective view of another exemplary alternative embodiment of an attachment ring.

FIG. 6 is an exploded perspective view of another exemplary alternative embodiment of an attachment ring 416. The attachment ring 416 includes a body 426, which is configured to extend at least partially around the end 22 (FIGS. 1 and 2) of the shield 18 (FIGS. 1 and 2). The body 426 of the attachment ring 416 includes at least two segments 428 and 430. The segments 428 and 430 are discrete from each other and are connected together to define the length of the body 426. The segment 428 extends a length from an end 450 to an opposite end 452, while the segment 430 extends a length from an end 454 to an opposite end 456. Each of ends 450 and 452 of the segment 428 includes a respective mechanical connector 458*a* and 458*b*, and each of the ends 454 and 456 of the segment 430 includes a mechanical connector 460*a* and 460*b*, respectively. The mechanical connector 458*a* of the end 450 of the segment 428 interlocks with the mechanical connector 460*a* of the end 454 of the segment 430 to connect the segments 428 and 430 together at the ends 450 and 454. Similarly, the mechanical connector 458*b* of the end 452 of the segment 428 interlocks with the mechanical connector 460*b* of the end 456 of the segment 430 to connect the segments 428 and 430 together at the ends 452 and 456. The mechanical connector 458*a* of the segment 428 is substantially identical to the mechanical connector 458*b* of the segment 428, while the mechanical connector 460*a* of the segment 430 is substantially identical to the mechanical connector 460*b* of the segment 430. Each of the segments 428 and 430 may be referred to herein as a "first segment" and/or a "second segment". The mechanical connectors 258*a*, 258*b*, 260*a*, and 260*b* may each be referred to herein as a "connection member" and/or a "connection feature".

The mechanical connectors 458*a* and 560*a* include reciprocal shapes relative to each other. The mechanical connector 458*a* includes a latch projection 462 having a base 464 and an end 466. The end 466 of the latch projection 462 includes a rear wall 470 that defines a latch shoulder 476 of the latch projection 462. The mechanical connector 460*a* includes a groove 480, which extends into the end 454 of the segment 430. Optionally, the groove 480 extends through an end wall 486 of the end 454 of the segment 430. The groove 480 includes a groove segment 488 that extends between opposing anti-twist members 504 of the mechanical connector 460*a*. Rear walls of the anti-twist members 504 define a latch shoulder 490 of the groove 480. The groove 480 also includes a recess 492 defined between the latch shoulder 490 and an end wall 494 of the groove 480.

To connect the end 450 of the segment 428 to the end 454 of the segment 430, the latch projection 462 of the mechanical connector 458*a* is inserted into the groove 480 of the mechanical connector 460*a*. The base 464 of the latch projection 462 is received within the groove segment 488 of the groove 480 such that the anti-twist members 504 straddle the base 464 of the latch projection 462. The end 466 of the latch projection 462 is received within the recess 492 of the groove 480. When the mechanical connectors 458*a* and 460*a* are interlocked together as described above, the latch shoulder 476 of the latch projection 462 engages the latch shoulder 490 of the groove 480 to hold the mechanical connectors 458*a* and 460*a* together. The anti-twist members 504 prevent the latch projection 462 from moving out of the groove 480 when the body 426 is twisted.

Figure 7:
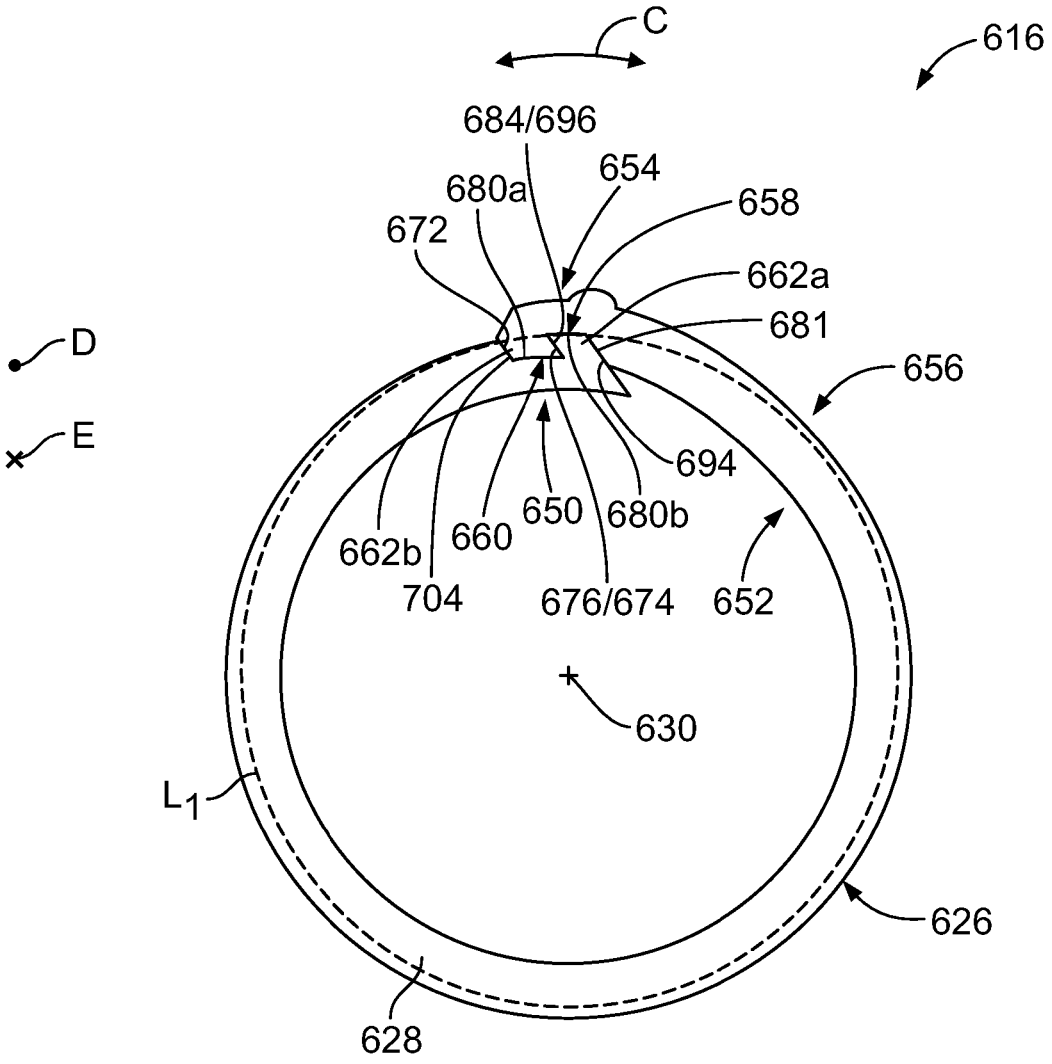
FIG. 7 is a plan view of another exemplary alternative embodiment of an attachment ring.
Figure 9:
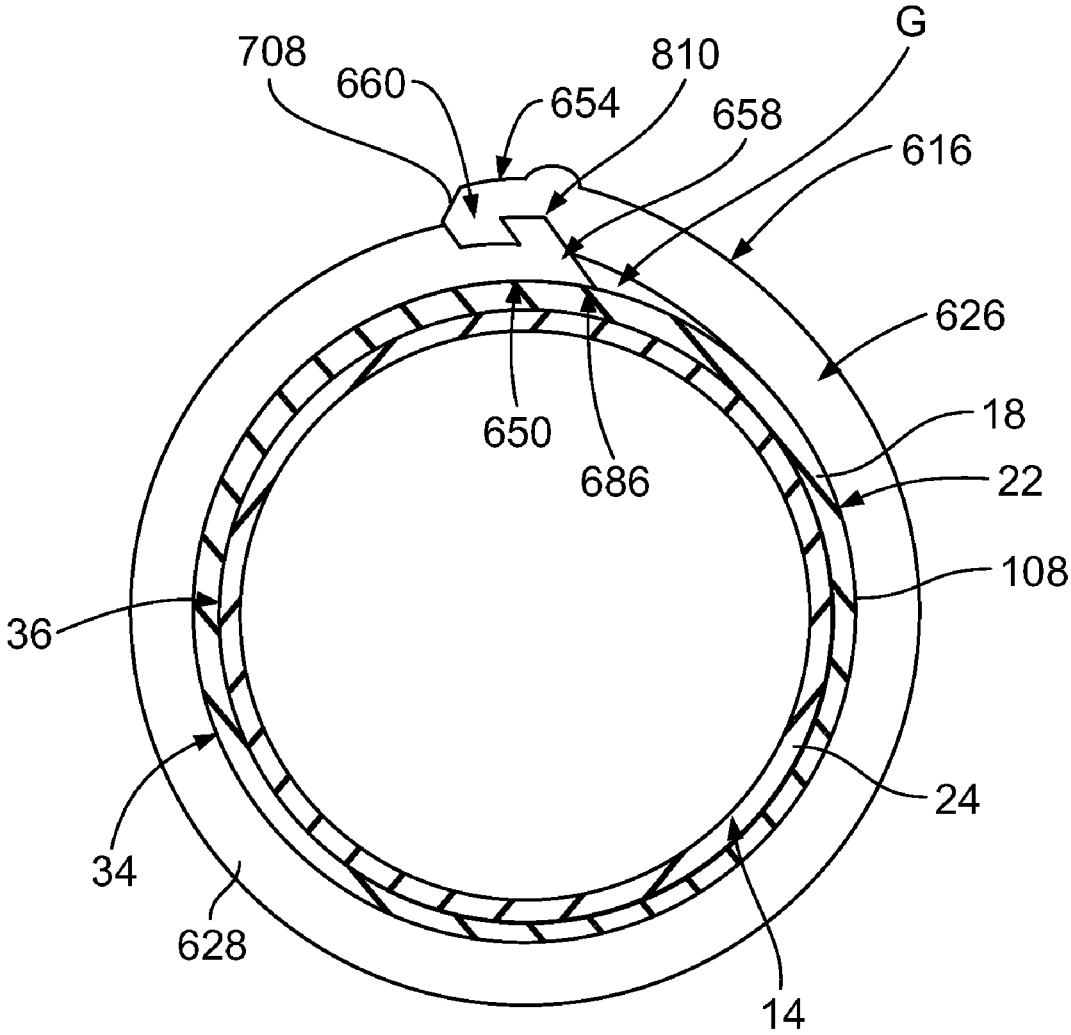
FIG. 9 is a cross-sectional view illustrating an exemplary shield of the electrical cable assembly shown in FIGS. 1 and 2 attached to an exemplary backshell of the electrical cable assembly shown in FIGS. 1 and 2 using the attachment ring shown in FIGS. 7 and 8.

FIG. 7 is a plan view of another exemplary alternative embodiment of an attachment ring 616. The attachment ring 616 includes an annular body 626, which is configured to extend at least partially around the end 22 (FIGS. 1, 2, and 9) of the shield 18 (FIGS. 1, 2, and 9). The body 626 extends around a central longitudinal axis 630 and includes a radially (relative to the axis 630) inner side 652 and a radially (relative to the axis 630) outer side 656 that is opposite the radially inner side 652. The body 626 includes a single segment 628 having opposing ends 650 and 654. When the ends 650 and 654 are connected together as shown in FIG. 7, the body 626 extends a length L1 that extends along a continuous annular path. In other words, the body 626 defines an annular shape that is a continuous ring when the ends 650 and 654 are connected together as shown in FIG. 7. The single segment 628 of the body 626 defines an entirety of the length L1 of the body 626. The length L1 of the body 626 is configured to extend at least partially around the circumferences 34 and 36 (FIGS. 1, 2, and 9) of the shield 18 (at the end 22) and the fitting 24 (FIGS. 1, 2, and 9), respectively, to hold the shield end 22 on the fitting 24 in contact with the fitting 24. Specifically, the body 626 engages the shield end 22 to hold the shield end 22 between the fitting 24 and the body 26. The length L1 of the body 626 may be referred to herein as an "arc length".

At least a portion of the body 626 of the attachment ring 616 is fabricated from one or more shape memory materials that recover upon exposure to a heat source. In other words, at least a portion of the body 626 of the attachment ring 616 is heat recoverable such that at least a portion of the body 626 shrinks upon the application of heat thereto. As will be described below, the body 626 of the attachment ring 616 is positioned over the end 22 of the shield 18 and exposed to a heat source (not shown) to shrink the body 626 into engagement with the shield end 22. The body 626 may be fabricated from one or more shape memory materials, such as, but not limited to, a titanium/nickel-based alloy, a titanium/nickel/niobium alloy, a titanium/nickel/iron alloy, a copper based alloy, and/or the like.

Figure 8:
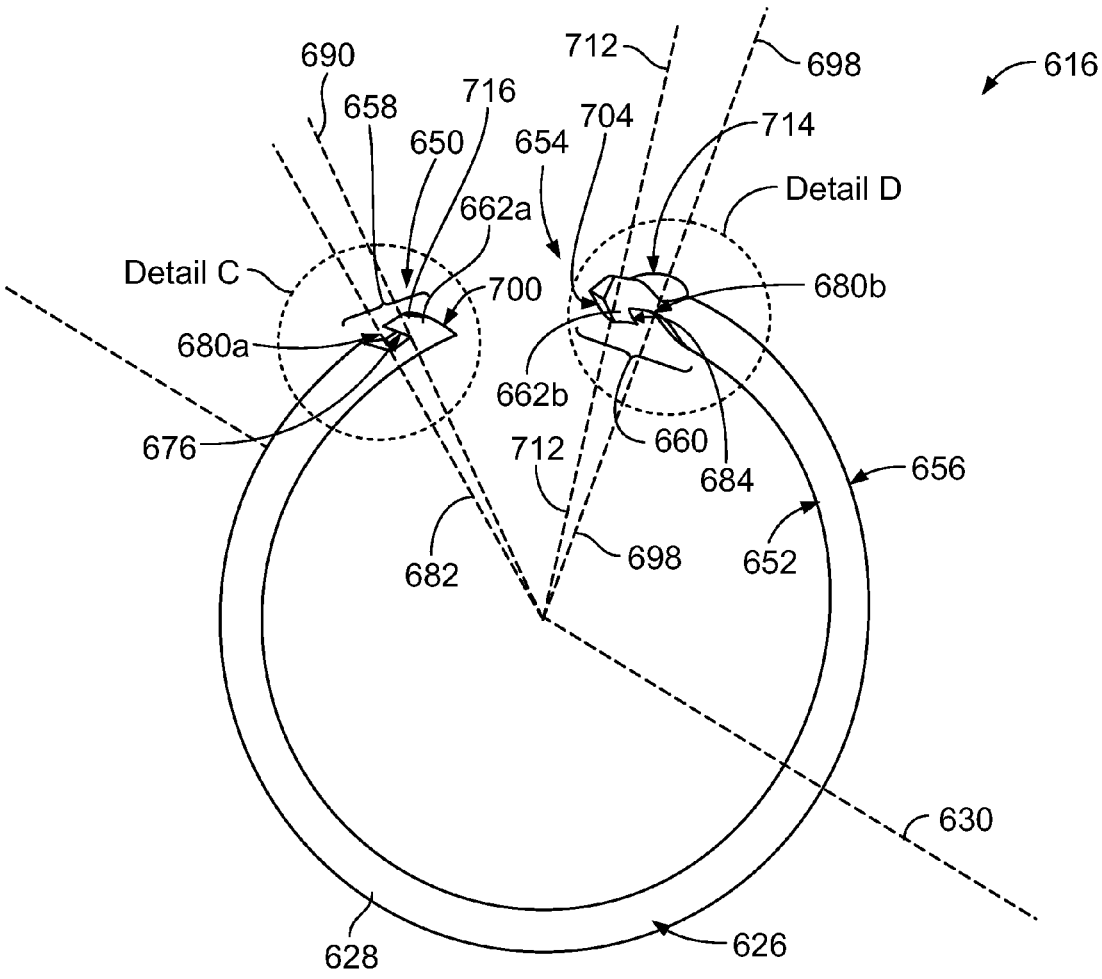
FIG. 8 is an exploded perspective view of the attachment ring shown in FIG. 7.

FIG. 8 is an exploded perspective view of the attachment ring 616. As briefly described above, the body 626 of the attachment ring 616 includes a single segment 628 having ends 650 and 654 that are configured to be connected together. FIG. 8 illustrates the body 626 in an exploded state wherein the ends 650 and 654 are not connected together. Each of the ends 650 and 654 of the segment 628 includes a mechanical connector 658 and 660, respectively. The mechanical connector 658 of the end 650 is configured to interlock with the mechanical connector 660 of the end 654 to connect the ends 650 and 654 together. Optionally, the mechanical connectors 658 and/or 660 are fabricated from the shape memory material(s) that recovers upon exposure to a heat source. For example, the ends 650 and/or 654 of the segment 628 are optionally fabricated from the shape memory material(s) that recovers upon exposure to a heat source.

In the exemplary embodiment of the body 626, the segment 628 includes a circular cross-sectional shape. But, the segment 628 may additionally or alternatively include any other cross-sectional shape, such as, but not limited to, a quadrilateral shape, an oval shape, and/or the like. Each of the ends 650 and 654 may be referred to herein as a "first" end and/or a "second" end. The mechanical connectors 658 and 660 may each be referred to herein as a "first connection member" and/or a "second connection member".

Figure 8A:
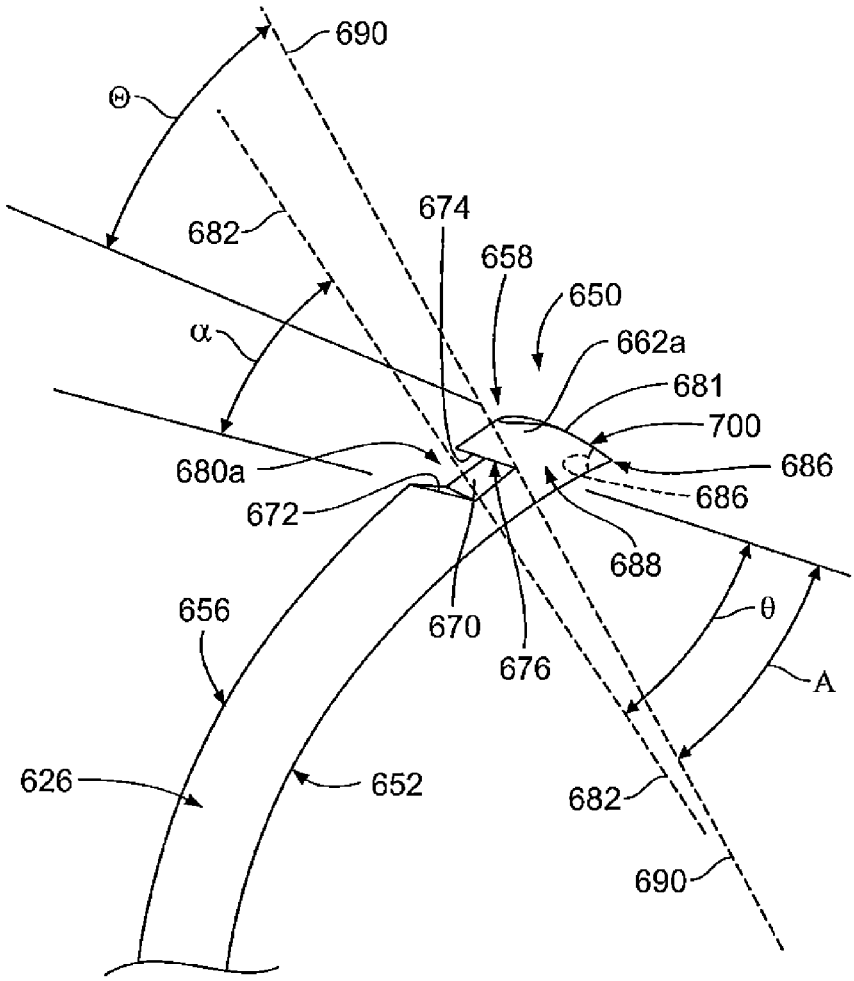
FIG. 8A shows Detail C of FIG. 8

Referring now to Detail C of FIG. 8A, in the exemplary embodiment, the mechanical connector 658 of the end 650 extends along the radially outer side 656 of the body 626. Alternatively, the mechanical connector 658 of the end 650 extends along the radially inner side 652 of the body 626. The mechanical connector 658 includes a latch projection 662*a* and a groove 680*a* that extends within the end 650. As will be described below, the groove 680*a* is configured to receive a latch projection 662*b* of the mechanical connector 660 therein to connect the ends 650 and 654 together. Although shown as having the general shape of a parallelepiped, the groove 680*a* may additionally or alternatively include any other shape for receiving a latch projection 662*b* that includes any shape. In the exemplary embodiment, the shape of the groove 680*a* is complementary with the shape of the latch projection 662*b*. As will also be described below, the latch projection 662*a* of the mechanical connector 658 is configured to be received within a groove 680*b* of the mechanical connector 660 to connect the ends 650 and 654 together. Although shown as having the general shape of a parallelepiped, the latch projection 662*a* may additionally or alternatively include any other shape for being received within a groove 680*b* that includes any shape. In the exemplary embodiment, the shape of the latch projection 662*a* is complementary with one or more shapes of the groove 680*b*.

The exemplary embodiment of the shape of the groove 680*a* of the mechanical connector 658 will now be described. The groove 680*a* is defined by a bottom surface 670 and two side surfaces 672 and 674 that intersect the bottom surface 670. The side surface 674 defines a latch shoulder 676 of the mechanical connector 658.

In the exemplary embodiment, the groove 680*a* extends into the body 626 at an oblique angle relative to the body 626. For example, the side surface 672 and/or the side surface 674 extends into the body 626 at an oblique angle relative to the body 626. In the exemplary embodiment, and as can be seen in FIG. 8A, the side surfaces 672 and 674 each extend at an oblique angle $\acute{\alpha}$, and θ, respectively, relative to a radial axis 682 that extends outward from the central longitudinal axis 630 (at an approximately perpendicular angle relative to the axis 630) and that intersects the groove 680*a*. The oblique angles of the side surfaces 672 and/or 674 may enable the side surfaces 672 and/or 674 to function as anti-twist surfaces that facilitate holding the latch projection 662*b* of the mechanical connector 660 within the groove 680*a* when the body 626 is twisted, as will be described below. Each of the side surfaces 672 and 674 may extend at any oblique angle relative to the radial axis 682, such as, but not limited to, between approximately 20° and approximately 70°, between approximately 30° and approximately 60°, approximately 45°, and/or the like. In some alternative embodiments, the side surface 672 or the side surface 674 does not extend at an oblique angle relative to the radial axis 682. The radial axis 682 may be referred to herein as a "first" radial axis.

The exemplary embodiment of the shape of the latch projection 662*a* of the mechanical connector 658 will now be described. The latch projection 662*a* is defined by the side surface 674 and a side surface 681. As described above, the side surface 674 defines the latch shoulder 676 of the mechanical connector 658. The side surface 681 defines a latch ramp 700 of the mechanical connector 658. The latch ramp 700 may have any amount of slope. The end 650 of the body 626 includes a tip 686 where the side surface 681 intersects the radially inner side 652 of the body 626. The tip 686 includes a portion of the side surface 681, a portion of the radially inner side 652, and the intersection point therebetween.

In the exemplary embodiment, the latch projection 662*a* extends outward at an oblique angle relative to a base portion 688 of the body 626 from which the latch projection 662*a* extends. For example, the side surface 674 and/or the side surface 681 extends outward at an oblique angle relative to the base portion 688 of the body 626. In the exemplary embodiment, and as can be seen in FIG. 8A, the side surfaces 674 and 680 each extend at an oblique angle 'A and Θ, respectively, relative to a radial axis 690 that extends outward from the central longitudinal axis 630 (at an approximately perpendicular angle relative to the axis 630) and that intersects the latch projection 662*a*. The oblique angles of the side surfaces 674 and/or 680 may enable the side surfaces 674 and/or 680 to function as anti-twist surfaces that facilitate holding the latch projection 662*a* within the groove 680*b* of mechanical connector 660 when the body 626 is twisted, as will be described below. Each of the side surfaces 674 and 680 may extend at any oblique angle relative to the radial axis 690, such as, but not limited to, between approximately 20° and approximately 70°, between approximately 30° and approximately 60°, approximately 45°, and/or the like. In some alternative embodiments, the side surface 674 or the side surface 681 does not extend at an oblique angle relative to the radial axis 690. The radial axis 690 may be referred to herein as a "second" radial axis.

In some embodiments, the end 650 of the body 626 is a pre-treated end that is heat treated before the body 626 is heat recovered. For example, the end 650 may be heat treated to prevent the end 650 (e.g., the mechanical connector 658) from deforming (or reduce the amount of deformation) during heat recovery of the body 626. One specific example of pre-treating the end 650 includes embodiments wherein the body 626 is in a martensite state after being manufactured but before being heat recovered. The end 650 may be heat treated to transform the end 650 from the martensite state to an austenite state wherein the end 650 experiences less or no deformation during heat recovery of the body 626.

In the exemplary embodiment of the body 626, the groove 680*a* of the mechanical connector 658 has a substantially identical shape as the groove 680*b* of the mechanical connector 660, and the latch projection 662*a* of the mechanical connector 658 has a substantially identical shape as the latch projection 662*b* of the mechanical connector 660. Alternatively, the groove 680*a* of the mechanical connector 658 includes a different shape than one or more shapes of the groove 680*b* of the mechanical connector 660, and/or the latch projection 662*a* of the mechanical connector 658 includes a different shape than one or more shapes of the latch projection 662*b* of the mechanical connector 660.

Figure 8B:
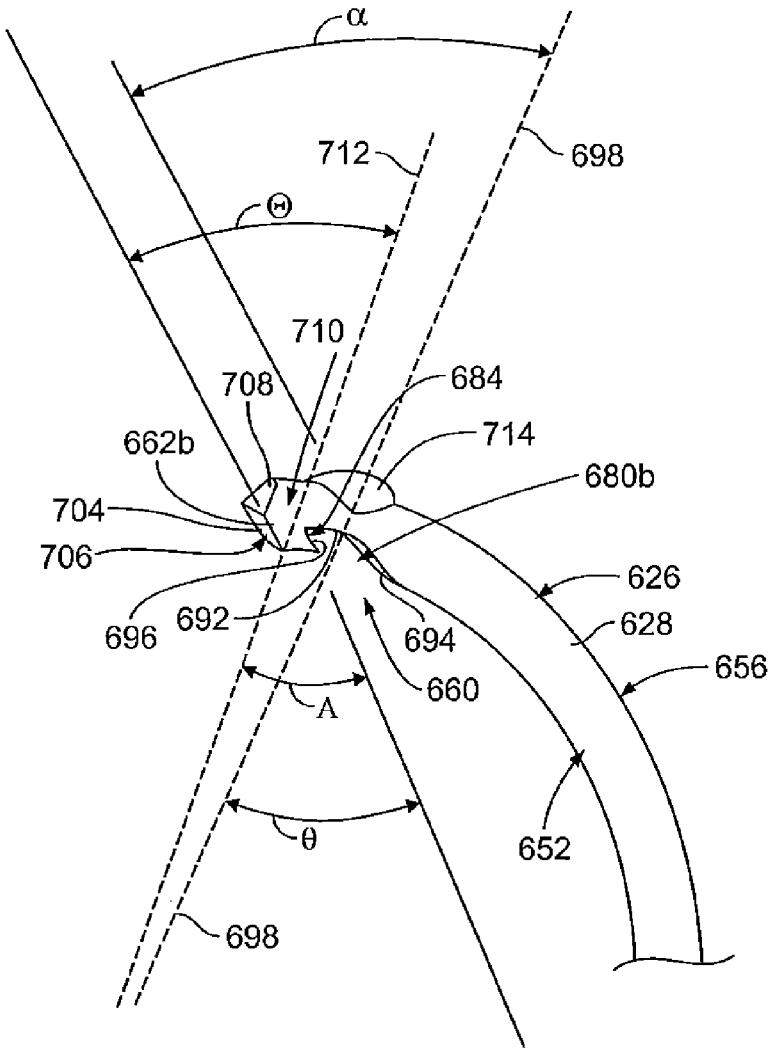
FIG. 8B shows Detail D of FIG. 8.

Referring now to Detail D of FIG. 8B, in the exemplary embodiment, the mechanical connector 660 of the end 654 extends along the radially inner side 652 of the body 626. Alternatively, the mechanical connector 660 of the end 654 extends along the radially outer side 656 of the body 626. The mechanical connector 660 includes the latch projection 662*b* and the groove 680*b*, which extends within the end 650. The groove 680*b* is configured to receive the latch projection 662*a* of the mechanical connector 658 therein to connect the ends 650 and 654 together. Although shown as having the general shape of a parallelepiped, the groove 680*b* may additionally or alternatively include any other shape for receiving a latch projection 662*a* that includes any shape. In the exemplary embodiment, the shape of the groove 680*b* is complementary with the shape of the latch projection 662*a*.

The latch projection 662*b* of the mechanical connector 660 is configured to be received within the groove 680*a* of the mechanical connector 658 to connect the ends 650 and 654 together. Although shown as having the general shape of a parallelepiped, the latch projection 662*b* may additionally or alternatively include any other shape for being received within a groove 680*a* that includes any shape. In the exemplary embodiment, the shape of the latch projection 662*b* is complementary with one or more shapes of the groove 680*a*.

The exemplary embodiment of the shape of the groove 680*b* of the mechanical connector 660 will now be described. The groove 680*b* is defined by a bottom surface 692 and two side surfaces 694 and 696 that intersect the bottom surface 692. The side surface 696 defines a latch shoulder 684 of the mechanical connector 660.

The groove 680*b* extends into the body 626 at an oblique angle relative to the body 626 in the exemplary embodiment. For example, the side surface 694 and/or the side surface 696 extends into the body 626 at an oblique angle relative to the body 626. In the exemplary embodiment, and as can be seen in FIG. 8B, the side surfaces 694 and 696 each extend at an oblique angle $\acute{\alpha}$, and θ, respectively, relative to a radial axis 698 that extends outward from the central longitudinal axis 630 (at an approximately perpendicular angle relative to the axis 630) and that intersects the groove 680*b*. The oblique angles of the side surfaces 694 and/or 696 may enable the side surfaces 694 and/or 696 to function as anti-twist surfaces that facilitate holding the latch projection 662*a* of the mechanical connector 658 within the groove 680*b* when the body 626 is twisted, as will be described below. Each of the side surfaces 694 and 696 may extend at any oblique angle relative to the radial axis 698, such as, but not limited to, between approximately 20° and approximately 70°, between approximately 30° and approximately 60°, approximately 45°, and/or the like. In some alternative embodiments, the side surface 694 or the side surface 696 does not extend at an oblique angle relative to the radial axis 698. The radial axis 698 may be referred to herein as a "first" radial axis.

The latch projection 662*b* of the mechanical connector 660 is defined by the side surface 696 and a side surface 704. As described above, the side surface 696 defines the latch shoulder 684 of the mechanical connector 660. The side surface 704 defines a ramp engagement shoulder 706 that is configured to engage the latch ramp 700 of the mechanical connector 658, as will be described below. In the exemplary embodiment, the end 654 of the body 626 does not include a tip (e.g., the tip 684 of the end 650), but rather includes a chamfer 708 in place of the tip. The chamfer 708 may eliminate a relatively sharp edge of the body 626 that would be formed by a tip of the end 654 when the ends 650 and 654 are connected together.

In the exemplary embodiment, the latch projection 662*b* extends outward at an oblique angle relative to a base portion 710 of the body 626 from which the latch projection 662*b* extends. For example, the side surface 696 and/or the side surface 704 extends outward at an oblique angle relative to the base portion 710 of the body 626. In the exemplary embodiment, and as can be seen in FIG. 8B, the side surfaces 696 and 704 each extend at an oblique angle 'A and Θ, respectively, relative to a radial axis 712 that extends outward from the central longitudinal axis 630 (at an approximately perpendicular angle relative to the axis 630) and that intersects the latch projection 662*b*. The oblique angles of the side surfaces 696 and/or 704 may enable the side surfaces 696 and/or 704 to function as anti-twist surfaces that facilitate holding the latch projection 662*b* within the groove 680*a* of mechanical connector 658 when the body 626 is twisted, as will be described below. Each of the side surfaces 696 and 704 may extend at any oblique angle relative to the radial axis 712, such as, but not limited to, between approximately 20° and approximately 70°, between approximately 30° and approximately 60°, approximately 45°, and/or the like. In some alternative embodiments, the side surface 694 and/or the side surface 704 does not extend at an oblique angle relative to the radial axis 712. The radial axis 712 may be referred to herein as a "second" radial axis.

Optionally, the body 626 includes a bump 714 of extra material that facilitates increasing the strength of the mechanical connector 660, for example the strength of the latch projection 662*b* and/or the groove 680*b*. The increased strength provided by the bump 714 may increase the force required to break the connection between the ends 650 and 654 when the mechanical connectors 658 and 660 are interlocked together. In addition or alternatively, the increased strength provided by the bump 714 may prevent or reduce the amount of deformation of the end 654 during heat recovery of the body 626.

The bump 714 may have any size, any shape, and may extend at any location along the body 626 that enables the bump 714 to facilitate increasing the strength of the mechanical connector 660. The size, shape, and location of the bump 714 may be selected to provide a predetermined amount of increased strength to the mechanical connector 660. Although shown as having the shape of a partial sphere, the bump 714 may additionally or alternatively include any other shape that enables the bump 714 to facilitate increasing the strength of the mechanical connector 660.

In the exemplary embodiment, the bump 714 extends along the radially outer side 656 of the body 626 generally opposite the mechanical connector 660. Specifically, the bump 714 extends along the radially outer side 656 at a location along the length L1 (FIG. 7) of the body 626 that is at least partially aligned with the location of the mechanical connector 660 along the length L1 of the body 626. The bump 714 overlaps the groove 680*b* along the length L1 of the body 626. In addition or alternatively to the exemplary location along the length L1*l* of the body 626, the bump 714 may have any other location along the length L1 of the body 626 that enables the bump 714 to facilitate increasing the strength of the mechanical connector 660. For example, the bump 714 may overlap the latch projection 662*b* along the length L1 of the body 626 in addition or alternative to overlapping the groove 680*b*. Moreover, in addition or alternatively to the exemplary location that is opposite the mechanical connector 660, the bump 714 may have any other location along the circumference of the segment 628 that enables the bump 714 to facilitate increasing the strength of the mechanical connector 660. For example, the bump 714 may be located along the radially inner side 652 of the body 626 and/or at one or more other locations on the radially outer side 656 that are not opposite the mechanical connector 660.

Although not shown, in some embodiments, the body 626 includes a bump of extra material that facilitates increasing the strength of the mechanical connector 658, for example the strength of the latch projection 662*a* and/or the groove 680*a*.

In some embodiments, the end 654 of the body 626 is a pre-treated end that is heat treated before the body 626 is heat recovered. For example, the end 654 may be heat treated to prevent the end 654 (e.g., the mechanical connector 660) from deforming (or reduce the amount of deformation) during heat recovery of the body 626. One specific example of pre-treating the end 654 includes embodiments wherein the body 626 is in a martensite state after being manufactured but before being heat recovered. The end 654 may be heat treated to transform the end 654 from the martensite state to an austenite state wherein the end 654 experiences less or no deformation during heat recovery of the body 626.

To connect the ends 650 and 654 of the body 626 together, the ends 650 and 652 are brought together such that the ramp engagement shoulder 706 of the mechanical connector 660 engages the ramp shoulder 700 of the mechanical connector 658. The latch projection 662*b* of the mechanical connector 660 rides along the latch ramp 700 and an end surface 716 of the latch projection 662*a* until the latch shoulder 684 of the latch projection 662*b* moves past the latch shoulder 676 of the latch projection 662*a*. Once the latch shoulder 684 has cleared the latch shoulder 676, the latch projection 662*b* of the mechanical connector 660 is received into the groove 680*a* of the mechanical connector 658 and the latch projection 662*a* of the mechanical connector 658 is received into the groove 680*b* of the mechanical connector 660. In the exemplary embodiment, the latch projections 662*a* and 662*b* snap into the respective grooves 680*b* and 680*a* such that the mechanical connectors 658 and 660 interlock together with a snap-fit arrangement. The segment 628 may bend along the length L1 of the segment 628 to enable the mechanical connectors 658 and 660 to interlock together with a snap-fit arrangement. Additionally or alternatively, the latch projections 662*a* and/or 662 may bend to enable the mechanical connectors 658 and 660 to interlock together with a snap-fit arrangement.

Referring again to FIG. 7, the ends 650 and 654 of the body 626 are shown connected together. When the mechanical connectors 658 and 660 are interlocked together as shown in FIG. 7, the latch projection 662*b* of the mechanical connector 660 is received into the groove 680*a* of the mechanical connector 658 and the latch projection 662*a* of the mechanical connector 658 is received into the groove 680*b* of the mechanical connector 660. The latch shoulders 676 and 684 engage each other to hold the mechanical connectors 658 and 660 together. Specifically, the engagement between the latch shoulders 676 and 684 prevents the ends 650 and 654 from being disconnected by being pulled apart as shown by the arrow C in FIG. 7.

As described above, the side surfaces 672, 674, 681, 694, 696, and/or 704 may function as anti-twist surfaces that facilitate holding the latch projections 662*a* and 662*b* within the respective grooves 680*b* and 680*a* when the body 626 is twisted. Specifically, twisting the body 626 of the attachment ring 616 may exert forces on the latch projections 662*a* and 662*b* in respective directions into or out of the page (as indicated by the arrows D and E, respectively, in FIG. 7), or vice versa. When the body 626 is twisted, the side surfaces 672, 674, 681, 694, 696, and/or 704 prevent the latch projections 662*a* and 662*b* from moving out of the grooves 680*b* and 680*a* in the respective directions D and E, or vice versa. For example, when the body 626 is twisted, the oblique angles of the side surfaces 672 and 704 causes the side surfaces 672 and 704 to press against each other, instead of slide along each other, and thereby resist movement of the latch projection 662*b* out of the groove 680*a*. Similarly, the oblique angles of the side surfaces 674 and 696 causes the side surfaces 674 and 696 to press against each other, instead of slide along each other, when the body 626 is twisted. The side surfaces 674 and 696 thereby resist movement of the latch projection 662*b* out of the groove 680*a* and resist movement of the latch projection 662*a* out of the groove 680*b*. When the body 626 is twisted, the oblique angles of the side surfaces 681 and 694 causes the side surfaces 681 and 694 to press against each other, instead of slide along each other, and thereby resist movement of the latch projection 662*a* out of the groove 680*b*. The side surfaces 672, 674, 681, 694, 696, and/or 704 may thereby prevent the latch projections 662*a* and/or 662 from moving out of the respective groove 680*b* and/or 680*a* to thereby hold the mechanical connectors 658 and 660 together when the body 626 is twisted.

FIG. 9 is a cross-sectional view illustrating the end 22 of the shield 18 attached to the backshell 14 using the attachment ring 616. To attach the end 22 of the shield 18 to the backshell 14, the shield end 22 is received over the fitting 24 of the backshell 14. The body 626 of the attachment ring 616 is then positioned over the end 22 of the shield 18. Specifically, the segment 628 is assembled over the end 22 of the shield 18. The ends 650 and 654 of the segment 628 are connected together by interlocking the mechanical connectors 658 and 660 as described above. Heat is then applied to the body 626 of the attachment ring 616 to recover, e.g., shrink, the body 626 into engagement with the end 22 of the shield 18. More particularly, exposing the body 626 to heat causes the diameter of the body 626 to reduce such that the body 626 engages the radially outer surface 108 of the shield 18. The length L1 (FIG. 7) of the body 626 extends at least partially around the circumferences 34 and 36 of the shield 18 (at the end 22) and the fitting 24. The body 626 thereby holds the shield end 22 between the fitting 24 and the body 26, as can be seen in FIG. 9. When the mechanical connectors 658 and/or 660 are fabricated from the shape memory material(s), shrinkage of a portion or all of the mechanical connectors 658 and/or 660 may facilitate increasing the strength of the interlocking connection between the mechanical connectors 658 and 660.

The tip 686 of the end 650 of the body 626 at least partially fills a gap G between the shield 18 and the body 626 of the attachment ring 616. In the exemplary embodiment, and as can be seen in FIG. 9, the tip 686 has a size and shape such that the tip 686 only fills a portion of the gap G. But, the tip 686 may alternatively include a size and shape such that the tip 686 completely fills the gap G between the shield 18 and the body 626. As can be seen in FIG. 9, the chamfer 708 of the end 654 of the body 626 eliminates a relatively sharp edge of the body 626 that would be formed by a tip of the end 654. Such a relatively sharp edge formed by a tip may cause the attachment ring 616 to snag on other objects, may damage other objects, and/or may injure (e.g., cut, scrape, and/or the like) an individual that comes into contact with the tip. Accordingly, the chamfer 708 may thereby reduce snagging, damage to other objects, and/or injury to a person that comes in to contact with the attachment ring 616.

Although the body 626 of the attachment ring 616 is described above as being assembled over the end 22 of the shield 18 after the shield end 22 is received over the fitting 24, the body 626 of the attachment ring 616 may be positioned over the shield end 22 before the shield end 22 is received over the fitting 24 (whether or not the end 650 and 654 of the segment 628 are connected together before the shield end 22 is received over the fitting 24). Heat may be applied to the body 626 of the attachment ring using any suitable method, structure, means, and/or the like, such as, but not limited to, thermally (e.g., using a heat gun, an oven, and/or the like), electrically (e.g., resistance heating and/or the like), and/or the like. Optionally, if heat is applied to the body 626 electrically, the body 626 may include an electrically insulating layer (not shown) that electrically isolates the body 626 from the shield 18 to force electrical current to flow through the body 626 during the electrical heating.

The single segment 628 of the body 626 enables side-entry of the attachment ring 616 over the end 22 of the shield 18 when the ends 650 and 658 are disconnected. Accordingly, the end 22 of the shield 18 and the insulated electrical conductors of the electrical cable 12 do not need to be fed through the attachment ring 616 to position the attachment ring 616 over the shield end 22. Moreover, the side-entry of the body 626 of the attachment ring 616 enables the attachment ring 616 to be positioned over the shield end 22 after the shield 22 has been received over the fitting 24 without positioning the attachment ring 616 over the other end of the shield 22 and moving the attachment ring 616 along the entire length of the electrical cable 12 to the shield end 22.

When it is desired to remove the attachment ring 616 from the shield 18 (e.g., to disassemble the end 20 of the electrical cable 12 from the electrical connector, and/or the like), the body 626 can be broken at a joint 810 between the mechanical connectors 658 and 660. For example, twisting of the body 626 at the joint 810 will break one or both of the mechanical connectors 658 and 660 to enable the ends 650 and 654 to come apart at the joint 810. The body 626 may be twisted at the joint 810 using any hand tool, such as, but not limited to, pliers, vice-grips, and/or the like. The mechanical connectors 658 and 660 are provided with a strength (after heat recovery) such that the ends 650 and 654 will not come apart during twisting of the body 626 during normal use, operation, and/or life of the attachment ring 616. However, the mechanical connectors 658 and 660 are provided with a strength (after heat recovery) that enables the mechanical connectors 658 and/or 660 to break when twisted at the joint 810 using the hand tool.

While the mechanical connectors 658 and 660 have the structures described above and illustrated in FIGS. 7-9, it should be understood that the mechanical connectors 658 and 660 may have other structures, such as, but not limited to, the structures of the mechanical connectors 58*a*, 60*a*, 58*b*, and/or 60*b*, the structures of the mechanical connectors 258*a*, 260*a*, 258*b*, and/or 260*b*, or the structures of the mechanical connectors 458*a*, 460*a*, 458*b*, and/or 460*b*.

The embodiments described and/or illustrated herein may provide an attachment ring that is less time-consuming, less difficult, and/or less costly to position over the end of a shield than at least some known attachment rings. The embodiments described and/or illustrated herein may provide an electrical cable that is less time-consuming, less difficult, and/or less costly to terminate to an electrical connector than at least some known electrical cables. The embodiments described and/or illustrated herein may increase the number of electrical cables that can be terminated to corresponding electrical connectors within a given time period. The embodiments described and/or illustrated herein may provide an attachment ring that is less difficult, less time consuming, and/or less costly to remove from a shield than at least some known attachment rings. The embodiments described and/or illustrated herein may provide an attachment ring that may be removed from a shield without using special tooling (e.g., without using an electrical power tool and/or the like). The embodiments described and/or illustrated herein may provide an attachment ring that may be removed from a shield without damaging a fitting of a backshell to which the shield is attached.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An attachment ring for attaching a shield of an electrical cable to a backshell, the attachment ring comprising:

an annular body comprising a shape memory material that is heat recoverable, the body being configured to extend at least partially around the shield and a fitting of the backshell to hold the shield on the fitting in contact with the fitting, wherein the body comprises a single segment comprising:

a first end having a first connection member; and a second end that opposes the first end, the second end having a second connection member that is configured to be interlocked with the first connection member of the first end to connect the first and second ends together such that the single segment of the body defines a continuous ring;

wherein the connection member of the first segment comprises a latch ramp and a latch shoulder, the connection feature of the second segment comprising a latch projection that tides along the latch ramp as the first and second segments are connected together and engages the latch shoulder to interlock the connection feature and the connection member;

wherein the connection between the first and second ends is configured to be broken by twisting the body at a joint of the first and second connection members;

the latch projection comprising a bump of extra material extending along the radially outer side of the body at a location along an arc length of the body that is at least partially aligned a location of the first connection member along the arc length of the projection.

2. The attachment ring of claim 1, wherein the body comprises a radially inner side and a radially outer side that is opposite the radially inner side, the first connection member of the first end extending along the radially inner side of the body, the second connection member of the second end extending along the radially outer side of the body.

3. The attachment ring of claim 1, wherein the first connection member of the first end comprises a groove that extends within the first end, the second connection member of the second end comprising a latch projection that is received within the groove of the first connection member such that the first and second ends are connected together.

4. The attachment ring of claim 1, wherein the first connection member of the first end comprises a groove that extends into the body at an oblique angle relative to the body, the second connection member of the second end comprising a latch projection that extends outward at an oblique angle relative to a portion of the body from which the latch projection extends, the latch projection being received within the groove such that the first and second ends are connected together.

5. The attachment ring of claim 1, wherein the first connection member and the second connection member each include a groove and a latch projection, the groove of the first connection member having a substantially identical shape to the groove of the second connection member, the latch projection of the first connection member having a substantially identical shape to the latch projection of the second connection member.

6. The attachment ring of claim 1, wherein the body comprises a radially inner side and a radially outer side that is opposite the radially inner side, the first connection member of the first end extending along the radially inner side of the body.

7. The attachment ring of claim 1, wherein at least one of the first end or the second end of the single segment of the body is a pre-treated end that has been heat treated to transform the end from a martensite state to an austenite state.

8. The attachment ring of claim 1, wherein the first and second connection members interlock with a snap-fit arrangement.

9. The attachment ring of claim 1, wherein at least one of the first connection member or the second connection member comprises a shape memory material that is heat recoverable.

10. The attachment ring of claim 1, wherein the first connection member of the first end comprises a groove that extends within the first end, the second connection member of the second end comprising a latch projection that is received within the groove of the first connection member such that the first and second ends are connected together, wherein the groove and the latch projection have complementary shapes relative to each other.

11. The attachment ring of claim 1, wherein the segment of the body comprises a cylindrical cross-sectional shape.

12. An electrical cable assembly comprising:

an electrical cable comprising a shield;

a backshell comprising a fitting, the shield of the electrical cable being received over the fitting; and an attachment ring for attaching the shield to the fitting, the attachment ring comprising an annular body comprising a shape memory material that is heat recoverable, the body being configured to extend at least partially around the shield and the fitting of the backshell to hold the shield on the fitting in contact with the fitting, wherein the body comprises a single segment comprising:

a first end having a first connection member; and a second end that opposes the first end, the second end having a second connection member that is configured to be interlocked with the first connection member of the first end to connect the first and second ends together such that the body defines a continuous ring, wherein the connection between the first and second ends is configured to be broken by twisting the body at a joint of the first and second connection members;

wherein the first connection member of the first end comprises a groove that extends into the body at an oblique angle relative to the body, the second connection member of the second end comprising a latch projection that extends outward at an oblique angle relative to a portion of the body from which the latch projection extends, the latch projection being received within the groove such that the first and second ends are connected together;

the latch projection comprising a bump of extra material extending along the radially outer side of the body at a location along an arc length of the body that is at least partially aligned a location of the first connection member along the arc length of the projection.

13. The assembly of claim 12, wherein the body comprises a radially inner side and a radially outer side that is opposite the radially inner side, the first connection member of the first end extending along the radially inner side of the body, the second connection member of the second end extending along the radially outer side of the body.

14. The attachment ring of claim 12, wherein the body comprises a radially inner side and a radially outer side that is opposite the radially inner side, the first connection member of the first end extending along the radially inner side of the body.

15. The assembly of claim 12, wherein at least one of the first end or the second end of the single segment of the body is a pre-treated end that has been heat treated to transform the end from a martensite state to an austenite state.

16. An attachment ring for attaching a shield of an electrical cable to a backshell, the attachment ring comprising:

an annular body comprising a shape memory material that is heat recoverable, the body being configured to extend at least partially around the shield and a fitting of the backshell to hold the shield on the fitting in contact with the fitting, wherein the body comprises a single segment comprising:

a first end having a first connection member that includes a groove that extends into the body at an oblique angle relative to the body; and a second end that opposes the first end, the second end having a second connection member, the second connection member comprising a latch projection that extends outward at an oblique angle relative to a portion of the body from which the latch projection extends, the latch projection being received within the groove such that the first and second connection members are interlocked;

wherein the connection between the first and second ends is configured to be broken by twisting the body at a joint of the first and second connection members;

the latch projection comprising a bump of extra material extending along the radially outer side of the body at a location along an arc length of the body that is at least partially aligned a location of the first connection member along the arc length of the projection.

17. The attachment ring of claim 16, wherein the body extends around a central longitudinal axis and first and second radial axes extend outward from the central longitudinal at an approximately perpendicular angle relative to the central longitudinal axis, the first radial axis intersecting the groove of the first connection member, the second radial axis intersecting the latch projection of the second connection member, wherein the groove includes a side surface that extends into the body at an oblique angle relative to the first radial axis and the latch projection includes a side surface that extends outward at an oblique angle relative to the second radial axis.

* * * * *